US011470436B2

(12) United States Patent
Laitinen et al.

(10) Patent No.: US 11,470,436 B2
(45) Date of Patent: Oct. 11, 2022

(54) SPATIAL AUDIO PARAMETERS AND ASSOCIATED SPATIAL AUDIO PLAYBACK

(71) Applicant: Nokia Technologies Oy, Espoo (FI)

(72) Inventors: Mikko-Ville Laitinen, Espoo (FI); Juha Vilkamo, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/045,334

(22) PCT Filed: Mar. 28, 2019

(86) PCT No.: PCT/FI2019/050253
§ 371 (c)(1),
(2) Date: Oct. 5, 2020

(87) PCT Pub. No.: WO2019/193248
PCT Pub. Date: Oct. 10, 2019

(65) Prior Publication Data

US 2021/0176579 A1 Jun. 10, 2021

(30) Foreign Application Priority Data

Apr. 6, 2018 (GB) ..... 1805811

(51) Int. Cl.
*H04S 7/00* (2006.01)
*G10L 25/21* (2013.01)
(Continued)

(52) U.S. Cl.
CPC ..... *H04S 7/30* (2013.01); *G10L 25/21* (2013.01); *H04R 3/005* (2013.01); *H04R 5/027* (2013.01);
(Continued)

(58) Field of Classification Search
CPC .... H04S 3/02; H04S 2400/15; H04S 2420/03; H04S 2420/11; H04S 7/30; H04S 2400/01; G10L 19/008; H04R 3/005; H04R 3/008
(Continued)

(56) References Cited

U.S. PATENT DOCUMENTS 9,369,164 B2 6/2016 Kim
9,747,905 B2 8/2017 Pang
(Continued)

FOREIGN PATENT DOCUMENTS

EP 2 560 161 A1 2/2013
GB 2554446 A 4/2018
(Continued)

OTHER PUBLICATIONS

Politis, Archontis, et al., "Enhancement of Ambisonic Binaural Reproduction using Directional Audio Coding with Optimal Adaptive Mixing", Oct. 15-18, 2017, New York, IEEE Workshop on Applications of Signal Processing to Audio and Acoustics, 1 pg., abstract only.
(Continued)

*Primary Examiner* — Xu Mei
(74) *Attorney, Agent, or Firm* — Harrington & Smith

(57) ABSTRACT

An apparatus including at least one processor and at least one memory including a computer program code, the at least one memory and the computer program code configured to, with the at least one processor, cause the apparatus at least to: determine, for two or more microphone audio signals, at least one spatial audio parameter for providing spatial audio reproduction; determine at least one coherence parameter associated with a sound field based on the two or more microphone audio signals, such that another sound field is
(Continued)

configured to be reproduced based on the at least one spatial audio parameter and the at least one coherence parameter.

20 Claims, 12 Drawing Sheets

(51) Int. Cl.

| | |
|---|---|
| ***H04R 3/00*** | (2006.01) |
| ***H04R 5/027*** | (2006.01) |
| ***H04R 5/04*** | (2006.01) |
| ***H04S 3/00*** | (2006.01) |
| ***H04S 3/02*** | (2006.01) |
| ***G10L 19/008*** | (2013.01) |

(52) U.S. Cl.
CPC ..... *H04R 5/04* (2013.01); *H04S 3/008* (2013.01); *H04S 3/02* (2013.01); *G10L 19/008* (2013.01); *H04S 2400/01* (2013.01); *H04S 2400/15* (2013.01); *H04S 2420/03* (2013.01); *H04S 2420/11* (2013.01)

(58) Field of Classification Search
USPC ..... 381/22, 23, 303
See application file for complete search history.

(56) References Cited

U.S. PATENT DOCUMENTS

| | | | | |
|---|---|---|---|---|
| 9,820,073 | B1 | 11/2017 | Foti | |
| 2005/0157883 | A1 | 7/2005 | Herre | 381/17 |
| 2006/0053018 | A1 | 3/2006 | Engdegard | 704/500 |
| 2007/0002971 | A1 | 1/2007 | Purnhagen | 375/316 |
| 2007/0127733 | A1 | 6/2007 | Henn | 381/80 |
| 2007/0233293 | A1 | 10/2007 | Villemoes et al. | 700/94 |
| 2007/0258607 | A1 | 11/2007 | Purnhagen | 381/307 |
| 2009/0110203 | A1 | 4/2009 | Taleb | 381/17 |
| 2010/0169102 | A1 | 7/2010 | Samsudin et al. | 704/500 |
| 2012/0082319 | A1 | 4/2012 | Jot | 381/63 |
| 2012/0163606 | A1* | 6/2012 | Eronen | H04S 7/302 381/22 |
| 2013/0216047 | A1 | 8/2013 | Kuech et al. | 381/26 |
| 2013/0262130 | A1 | 10/2013 | Ragot | 704/500 |
| 2014/0233762 | A1* | 8/2014 | Vilkamo | G10H 1/183 381/119 |
| 2015/0170657 | A1 | 6/2015 | Thompson et al. | |
| 2019/0066701 | A1 | 2/2019 | Fatus | |
| 2019/0156841 | A1 | 5/2019 | Fatus | |
| 2019/0394606 | A1* | 12/2019 | Tammi | G10L 19/008 |
| 2020/0045494 | A1 | 2/2020 | Liu | |
| 2021/0219084 | A1 | 7/2021 | Laitinen | |

FOREIGN PATENT DOCUMENTS

| | | | |
|---|---|---|---|
| JP | 2007531915 | A | 11/2007 |
| WO | WO 2005/101370 | A1 | 10/2005 |
| WO | WO 2005/101905 | A1 | 10/2005 |
| WO | WO 2008/032255 | A2 | 3/2008 |
| WO | WO 2008/046531 | A1 | 4/2008 |
| WO | WO 2008/100098 | A1 | 8/2008 |
| WO | WO 2010/080451 | A1 | 7/2010 |
| WO | WO-2017/153697 | A1 | 9/2017 |
| WO | WO 2019/086757 | A1 | 5/2019 |

OTHER PUBLICATIONS

3GPP TSG-SA4#98 meeting, Apr. 9-13, 2018, Kista, Sweden, Tdoc S4 (18)0462, "On spatial metadata for IVAS spatial audio input format", Nokia Corporation, 7 pgs.

3GPP TSG-SA4#102 meeting, Jan. 28-Feb. 1, 2019, Bruges, Belgium, Tdoc S4 (19)0121, "Proposal for MASA format" Nokia Corporation, 10 pgs.

Ahrens, Jens et al. "Two Physical Models for Spatially Extended Virtual Sound Sources", AES Convention 131, Oct. 2011, AES, New York, USA, Oct. 19, 2011.

Politis, Archontis, et al., "Sector-Based Parametric Sound Field Reproduction in the Spherical Harmonic Domain", IEEE Journal of Selected Topics in Signal Processing, Jul. 14, 2015, 2 pgs.

Pulkki, Ville, "Virtual Sound Source Positioning Using Vector Base Amplitude Panning", © Audio Engineering Society, Inc. 1997, 11 pgs.

Lebart, K., et al., "A New Method Based on Spectral Subtraction for Speech Dereverberation", Acustica vol. 87, pp. 359-366, Apr. 2001.

Vilkamo, Juha, et al., "Optimized Covariance Domain Framework for Time-Frequency Processing of Spatial Audio", J. Audio Eng. Soc., vol. 61, No. 6, pp. 403-411, Jun. 2013.

Laitinen, Mikko-Ville, et al., "Utilizing Instantaneous Direct-to-Reverberant Ratio in Parametric Spatial Audio Coding", Audio Engineering Society Convention Paper 8804, 10 pages, Oct. 2012.

* cited by examiner

SPATIAL AUDIO PARAMETERS AND ASSOCIATED SPATIAL AUDIO PLAYBACK

CROSS REFERENCE TO RELATED APPLICATION

This patent application is a U.S. National Stage application of International Patent Application Number PCT/FI2019/050253 filed Mar. 28, 2019, which is hereby incorporated by reference in its entirety, and claims priority to GB 1805811.5 filed Apr. 6, 2018.

FIELD

The present application relates to apparatus and methods for sound-field related parameter estimation in frequency bands, but not exclusively for time-frequency domain sound-field related parameter estimation for an audio encoder and decoder.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

The directions and direct-to-total energy ratios in frequency bands are thus a parameterization that is particularly effective for spatial audio capture.

SUMMARY

There is provided according to a first aspect an apparatus comprising at least one processor and at least one memory including a computer program code, the at least one memory and the computer program code configured to, with the at least one processor, cause the apparatus at least to: determine, for two or more microphone audio signals, at least one spatial audio parameter for providing spatial audio reproduction; determine at least one coherence parameter associated with a sound field based on the two or more microphone audio signals, such that the sound field is configured to be reproduced based on the at least one spatial audio parameter and the at least one coherence parameter.

There is provided according to a further aspect an apparatus comprising at least one processor and at least one memory including a computer program code, the at least one memory and the computer program code configured to, with the at least one processor, cause the apparatus at least to: determine, for two or more microphone audio signals, at least one spatial audio parameter for providing spatial audio reproduction; determine at least one coherence parameter based on a determination of coherence within a sound field based on the two or more microphone audio signals, such that the sound field is configured to be reproduced based on the at least one spatial audio parameter and the at least one coherence parameter.

The apparatus caused to determine at least one coherence parameter associated with a sound field based on the two or more microphone audio signals may be further caused to determine at least one of: at least one spread coherence parameter, the at least one spread coherence parameter being associated with a coherence of a directional part of the sound field; and at least one surrounding coherence parameter, the at least one surrounding coherence parameter being associated with a coherence of a non-directional part of the sound field.

The apparatus caused to determine, for two or more microphone audio signals, at least one spatial audio parameter for providing spatial audio reproduction may be further caused to determine, for the two or more microphone audio signals, at least one of: a direction parameter; an energy ratio parameter; a direct-to-total energy parameter; a directional stability parameter; an energy parameter.

The apparatus may be further caused to determine an associated audio signal based on the two or more microphone audio signals, wherein the sound field can be reproduced based on the at least one spatial audio parameter, the at least one coherence parameter and the associated audio signal.

The apparatus caused to determine at least one coherence parameter associated with a sound field based on the two or more microphone audio signals, may be further caused to: determine zeroth and first order spherical harmonics based on the two or more microphone audio signals; generate at least one general coherence parameter based on the zeroth and first order spherical harmonics; and generate the at least one coherence parameter based on the at least one general coherence parameter.

The apparatus caused to determine zeroth and first order spherical harmonics based on the two or more microphone audio signals, may be further caused to perform one of: determine time domain zeroth and first order spherical harmonics based on the two or more microphone audio signals and convert the time domain zeroth and first order spherical harmonics to time-frequency domain zeroth and first order spherical harmonics; and convert the two or more microphone audio signals into respective two or more time-frequency domain microphone audio signals, and generate time-frequency domain zeroth and first order spherical harmonics based on the time-frequency domain microphone audio signals.

The apparatus caused to generate the at least one coherence parameter based on the at least one general coherence parameter may be caused to generate: at least one spread coherence parameter based on the at least one general coherence parameter and an energy ratio configured to define a relationship between a direct part and an ambient part of the sound field; at least one surrounding coherence parameter based on the at least one general coherence parameter and an energy ratio configured to define a relationship between a direct part and an ambient part of the of the sound field.

The apparatus caused to determine at least one coherence parameter associated with a sound field based on the two or more microphone audio signals, may be further caused to: convert the two or more microphone audio signals into respective two or more time-frequency domain microphone audio signals; determine at least one estimate of non-reverberant sound based on the two or more time-frequency domain microphone audio signals; determine at least one surrounding coherence parameter based on the at least one estimate of non-reverberant sound and an energy ratio configured to define a relationship between a direct part and an ambient part of the sound field.

The apparatus caused to determine at least one coherence parameter associated with a sound field based on the two or more microphone audio signals, may be further caused to select one of: the at least one surrounding coherence parameter based on the at least one estimate of non-reverberant sound and an energy ratio and the at least one surrounding coherence parameter based on the at least one general coherence parameter, based on which surrounding coherence parameter is largest.

The apparatus caused to determine at least one coherence parameter associated with a sound field based on the two or more microphone audio signals may be caused to determine at least one coherence parameter associated with a sound field based on the two or more microphone audio signals and for two or more frequency bands.

According to a second aspect there is provided an apparatus comprising at least one processor and at least one memory including a computer program code, the at least one memory and the computer program code configured to, with the at least one processor, cause the apparatus at least to: receive at least one audio signal, the at least one audio signal based on two or more microphone audio signals; receive at least one coherence parameter, associated with a sound field based on two or more microphone audio signals; receive at least one spatial audio parameter for providing spatial audio reproduction; reproduce the sound field based on the at least one audio signal, the at least one spatial audio parameter and the at least one coherence parameter.

The apparatus caused to receive at least one coherence parameter may be further caused to receive at least one of: at least one spread coherence parameter for the at least two frequency bands, the at least one spread coherence parameter being associated with a coherence of a directional part of the sound field; and at least one surrounding coherence parameter, the at least one surrounding coherence parameter being associated with a coherence of a non-directional part of the sound field.

The at least one spatial audio parameter may comprise at least one of: a direction parameter; an energy ratio parameter; a direct-to-total energy parameter; a directional stability parameter; and an energy parameter, and the apparatus caused to reproduce the sound field based on the at least one audio signal, the at least one spatial audio parameter and the at least one coherence parameter may be further caused to: determine a target covariance matrix from the at least one spatial audio parameter, the at least one coherence parameter and an estimated energy of the at least one audio signal; generate a mixing matrix based on the target covariance matrix and estimated energy of the at least one audio signal; apply the mixing matrix to the at least one audio signal to generate at least two output spatial audio signals for reproducing the sound field.

The apparatus caused to determine a target covariance matrix from the at least one spatial audio parameter, the at least one coherence parameter and the energy of the at least one audio signal may be further caused to: determine a total energy parameter based on the energy of the at least one audio signal; determine a direct energy and an ambience energy based on at least one of the energy ratio parameter; a direct-to-total energy parameter; and a directional stability parameter; and an energy parameter; estimate an ambience covariance matrix based on the determined ambience energy and one of the at least one coherence parameters; estimate at least one of: a vector of amplitude panning gains; an Ambisonic panning vector or at least one head related transfer function, based on an output channel configuration and/or the at least one direction parameter; estimate a direct covariance matrix based on: the vector of amplitude panning gains, Ambisonic panning vector or the at least one head related transfer function; a determined direct part energy; and a further one of the at least one coherence parameters; and generate the target covariance matrix by combining the ambience covariance matrix and direct covariance matrix.

According to a third aspect there is provided a method comprising: determining, for two or more microphone audio signals, at least one spatial audio parameter for providing spatial audio reproduction; and determining at least one coherence parameter associated with a sound field based on the two or more microphone audio signals, such that the sound field is configured to be reproduced based on the at least one spatial audio parameter and the at least one coherence parameter.

Determining at least one coherence parameter associated with a sound field based on the two or more microphone audio signals may further comprise determining at least one of: at least one spread coherence parameter, the at least one spread coherence parameter being associated with a coherence of a directional part of the sound field; and at least one surrounding coherence parameter, the at least one surrounding coherence parameter being associated with a coherence of a non-directional part of the sound field.

Determining, for two or more microphone audio signals, at least one spatial audio parameter for providing spatial audio reproduction may further comprise determining, for the two or more microphone audio signals, at least one of: a direction parameter; an energy ratio parameter; a direct-to-total energy parameter; a directional stability parameter; an energy parameter.

The method may further comprise determining an associated audio signal based on the two or more microphone audio signals, wherein the sound field can be reproduced based on the at least one spatial audio parameter, the at least one coherence parameter and the associated audio signal.

Determining at least one coherence parameter associated with a sound field based on the two or more microphone audio signals, may further comprise: determining zeroth and first order spherical harmonics based on the two or more microphone audio signals; generating at least one general coherence parameter based on the zeroth and first order spherical harmonics; and generating the at least one coherence parameter based on the at least one general coherence parameter.

Determining zeroth and first order spherical harmonics based on the two or more microphone audio signals may further comprise one of: determining time domain zeroth and first order spherical harmonics based on the two or more microphone audio signals and converting the time domain zeroth and first order spherical harmonics to time-frequency domain zeroth and first order spherical harmonics; and converting the two or more microphone audio signals into respective two or more time-frequency domain microphone audio signals, and generating time-frequency domain zeroth and first order spherical harmonics based on the time-frequency domain microphone audio signals.

Generating the at least one coherence parameter based on the at least one general coherence parameter may further comprise generating: at least one spread coherence parameter based on the at least one general coherence parameter and an energy ratio configured to define a relationship between a direct part and an ambient part of the sound field; and at least one surrounding coherence parameter based on the at least one general coherence parameter and an energy ratio configured to define a relationship between a direct part and an ambient part of the of the sound field.

Determining at least one coherence parameter associated with a sound field based on the two or more microphone audio signals, may further comprise: converting the two or more microphone audio signals into respective two or more time-frequency domain microphone audio signals; determining at least one estimate of non-reverberant sound based on the two or more time-frequency domain microphone audio signals; and determining at least one surrounding coherence parameter based on the at least one estimate of non-reverberant sound and an energy ratio configured to define a relationship between a direct part and an ambient part of the sound field.

Determining at least one coherence parameter associated with a sound field based on the two or more microphone audio signals, may further comprise: selecting one of: the at least one surrounding coherence parameter based on the at least one estimate of non-reverberant sound and an energy ratio and the at least one surrounding coherence parameter based on the at least one general coherence parameter, based on which surrounding coherence parameter is largest.

Determining at least one coherence parameter associated with a sound field based on the two or more microphone audio signals may further comprise determining at least one coherence parameter associated with a sound field based on the two or more microphone audio signals and for two or more frequency bands.

According to a fourth aspect there is provided a method comprising: receiving at least one audio signal, the at least one audio signal based on two or more microphone audio signals; receiving at least one coherence parameter, associated with a sound field based on two or more microphone audio signals; receiving at least one spatial audio parameter for providing spatial audio reproduction; and reproducing the sound field based on the at least one audio signal, the at least one spatial audio parameter and the at least one coherence parameter.

Receiving at least one coherence parameter may further comprise receiving at least one of: at least one spread coherence parameter for the at least two frequency bands, the at least one spread coherence parameter being associated with a coherence of a directional part of the sound field; and at least one surrounding coherence parameter, the at least one surrounding coherence parameter being associated with a coherence of a non-directional part of the sound field.

The at least one spatial audio parameter may comprise at least one of: a direction parameter; an energy ratio parameter; a direct-to-total energy parameter; a directional stability parameter; and an energy parameter, and reproducing the sound field based on the at least one audio signal, the at least one spatial audio parameter and the at least one coherence parameter may further comprise: determining a target covariance matrix from the at least one spatial audio parameter, the at least one coherence parameter and an estimated energy of the at least one audio signal; generating a mixing matrix based on the target covariance matrix and estimated energy of the at least one audio signal; and applying the mixing matrix to the at least one audio signal to generate at least two output spatial audio signals for reproducing the sound field.

Determining a target covariance matrix from the at least one spatial audio parameter, the at least one coherence parameter and the energy of the at least one audio signal may further comprise: determining a total energy parameter based on the energy of the at least one audio signal; determining a direct energy and an ambience energy based on at least one of the energy ratio parameter; a direct-to-total energy parameter; and a directional stability parameter; and an energy parameter;

estimating an ambience covariance matrix based on the determined ambience energy and one of the at least one coherence parameters; estimating at least one of: a vector of amplitude panning gains; an Ambisonic panning vector or at least one head related transfer function, based on an output channel configuration and/or the at least one direction parameter; estimating a direct covariance matrix based on: the vector of amplitude panning gains, Ambisonic panning vector or the at least one head related transfer function; a determined direct part energy; and a further one of the at least one coherence parameters; and generating the target covariance matrix by combining the ambience covariance matrix and direct covariance matrix.

According to a fifth aspect there is provided an apparatus comprising means for: determining, for two or more microphone audio signals, at least one spatial audio parameter for providing spatial audio reproduction; and determining at least one coherence parameter associated with a sound field based on the two or more microphone audio signals, such that the sound field is configured to be reproduced based on the at least one spatial audio parameter and the at least one coherence parameter.

The means for determining at least one coherence parameter associated with a sound field based on the two or more microphone audio signals may further be configured for determining at least one of: at least one spread coherence parameter, the at least one spread coherence parameter being associated with a coherence of a directional part of the sound field; and at least one surrounding coherence parameter, the at least one surrounding coherence parameter being associated with a coherence of a non-directional part of the sound field.

The means for determining, for two or more microphone audio signals, at least one spatial audio parameter for providing spatial audio reproduction may further be configured for determining, for the two or more microphone audio signals, at least one of: a direction parameter; an energy ratio parameter; a direct-to-total energy parameter; a directional stability parameter; an energy parameter.

The means may be further configured for determining an associated audio signal based on the two or more microphone audio signals, wherein the sound field can be reproduced based on the at least one spatial audio parameter, the at least one coherence parameter and the associated audio signal.

The means for determining at least one coherence parameter associated with a sound field based on the two or more microphone audio signals, may further be configured for: determining zeroth and first order spherical harmonics based on the two or more microphone audio signals; generating at least one general coherence parameter based on the zeroth and first order spherical harmonics; and generating the at least one coherence parameter based on the at least one general coherence parameter.

The means for determining zeroth and first order spherical harmonics based on the two or more microphone audio signals may further be configured for one of: determining time domain zeroth and first order spherical harmonics based on the two or more microphone audio signals and converting the time domain zeroth and first order spherical harmonics to time-frequency domain zeroth and first order spherical harmonics; and converting the two or more microphone audio signals into respective two or more time-frequency domain microphone audio signals, and generating time-frequency domain zeroth and first order spherical harmonics based on the time-frequency domain microphone audio signals.

The means for generating the at least one coherence parameter based on the at least one general coherence parameter may further be configured for generating: at least one spread coherence parameter based on the at least one general coherence parameter and an energy ratio configured to define a relationship between a direct part and an ambient part of the sound field; and at least one surrounding coherence parameter based on the at least one general coherence parameter and an energy ratio configured to define a relationship between a direct part and an ambient part of the of the sound field.

The means for determining at least one coherence parameter associated with a sound field based on the two or more microphone audio signals, may further be configured for: converting the two or more microphone audio signals into respective two or more time-frequency domain microphone audio signals; determining at least one estimate of non-reverberant sound based on the two or more time-frequency domain microphone audio signals; and determining at least one surrounding coherence parameter based on the at least one estimate of non-reverberant sound and an energy ratio configured to define a relationship between a direct part and an ambient part of the sound field.

The means for determining at least one coherence parameter associated with a sound field based on the two or more microphone audio signals, may further be configured for selecting one of: the at least one surrounding coherence parameter based on the at least one estimate of non-reverberant sound and an energy ratio and the at least one surrounding coherence parameter based on the at least one general coherence parameter, based on which surrounding coherence parameter is largest.

The means for determining at least one coherence parameter associated with a sound field based on the two or more microphone audio signals may further be configured for determining at least one coherence parameter associated with a sound field based on the two or more microphone audio signals and for two or more frequency bands.

According to a sixth aspect there is provided an apparatus comprising means for: receiving at least one audio signal, the at least one audio signal based on two or more microphone audio signals; receiving at least one coherence parameter, associated with a sound field based on two or more microphone audio signals; receiving at least one spatial audio parameter for providing spatial audio reproduction; and reproducing the sound field based on the at least one audio signal, the at least one spatial audio parameter and the at least one coherence parameter.

The means for receiving at least one coherence parameter may further be configured for receiving at least one of: at least one spread coherence parameter for the at least two frequency bands, the at least one spread coherence parameter being associated with a coherence of a directional part of the sound field; and at least one surrounding coherence parameter, the at least one surrounding coherence parameter being associated with a coherence of a non-directional part of the sound field.

The at least one spatial audio parameter may comprise at least one of: a direction parameter; an energy ratio parameter; a direct-to-total energy parameter; a directional stability parameter; and an energy parameter, and the means for reproducing the sound field based on the at least one audio signal, the at least one spatial audio parameter and the at least one coherence parameter may further be configured for: determining a target covariance matrix from the at least one spatial audio parameter, the at least one coherence parameter and an estimated energy of the at least one audio signal; generating a mixing matrix based on the target covariance matrix and estimated energy of the at least one audio signal; and applying the mixing matrix to the at least one audio signal to generate at least two output spatial audio signals for reproducing the sound field.

The means for determining a target covariance matrix from the at least one spatial audio parameter, the at least one coherence parameter and the energy of the at least one audio signal may further be configured for: determining a total energy parameter based on the energy of the at least one audio signal; determining a direct energy and an ambience energy based on at least one of the energy ratio parameter; a direct-to-total energy parameter; and a directional stability parameter; and an energy parameter; estimating an ambience covariance matrix based on the determined ambience energy and one of the at least one coherence parameters; estimating at least one of: a vector of amplitude panning gains; an Ambisonic panning vector or at least one head related transfer function, based on an output channel configuration and/or the at least one direction parameter; estimating a direct covariance matrix based on: the vector of amplitude panning gains, Ambisonic panning vector or the at least one head related transfer function; a determined direct part energy; and a further one of the at least one coherence parameters; and generating the target covariance matrix by combining the ambience covariance matrix and direct covariance matrix.

According to a seventh aspect there is provided a computer program comprising instructions [or a computer readable medium comprising program instructions] for causing an apparatus to perform at least the following: determining, for two or more microphone audio signals, at least one spatial audio parameter for providing spatial audio reproduction; and determining at least one coherence parameter associated with a sound field based on the two or more microphone audio signals, such that the sound field is configured to be reproduced based on the at least one spatial audio parameter and the at least one coherence parameter.

According to an eighth aspect there is provided a computer program comprising instructions [or a computer readable medium comprising program instructions] for causing an apparatus to perform at least the following: receiving at least one audio signal, the at least one audio signal based on two or more microphone audio signals; receiving at least one coherence parameter, associated with a sound field based on two or more microphone audio signals; receiving at least one spatial audio parameter for providing spatial audio reproduction; and reproducing the sound field based on the at least one audio signal, the at least one spatial audio parameter and the at least one coherence parameter.

According to a ninth aspect there is provided a non-transitory computer readable medium comprising program instructions for causing an apparatus to perform at least the following: determining, for two or more microphone audio signals, at least one spatial audio parameter for providing spatial audio reproduction; and determining at least one coherence parameter associated with a sound field based on the two or more microphone audio signals, such that the sound field is configured to be reproduced based on the at least one spatial audio parameter and the at least one coherence parameter.

According to a tenth aspect there is provided a non-transitory computer readable medium comprising program instructions for causing an apparatus to perform at least the following: receiving at least one audio signal, the at least one audio signal based on two or more microphone audio signals; receiving at least one coherence parameter, associated with a sound field based on two or more microphone audio signals; receiving at least one spatial audio parameter for providing spatial audio reproduction; and reproducing the sound field based on the at least one audio signal, the at least one spatial audio parameter and the at least one coherence parameter.

According to an eleventh aspect there is provided an apparatus comprising: determining circuitry configured to determine, for two or more microphone audio signals, at least one spatial audio parameter for providing spatial audio reproduction; and the determining circuitry further configured to determine at least one coherence parameter associated with a sound field based on the two or more microphone audio signals, such that the sound field is configured to be reproduced based on the at least one spatial audio parameter and the at least one coherence parameter.

According to a twelfth aspect there is provided an apparatus comprising: receiving circuitry configured to receive at least one audio signal, the at least one audio signal based on two or more microphone audio signals; the receiving circuitry further configured to receive at least one coherence parameter, associated with a sound field based on two or more microphone audio signals; the receiving circuitry further configured to receive at least one spatial audio parameter for providing spatial audio reproduction; and reproducing circuitry configured to reproduce the sound field based on the at least one audio signal, the at least one spatial audio parameter and the at least one coherence parameter.

According to a thirteenth aspect there is provided a computer readable medium comprising program instructions for causing an apparatus to perform at least the following: determining, for two or more microphone audio signals, at least one spatial audio parameter for providing spatial audio reproduction; and determining at least one coherence parameter associated with a sound field based on the two or more microphone audio signals, such that the sound field is configured to be reproduced based on the at least one spatial audio parameter and the at least one coherence parameter.

According to a fourteenth aspect there is provided a computer readable medium comprising program instructions for causing an apparatus to perform at least the following: receiving at least one audio signal, the at least one audio signal based on two or more microphone audio signals; receiving at least one coherence parameter, associated with a sound field based on two or more microphone audio signals; receiving at least one spatial audio parameter for providing spatial audio reproduction; and reproducing the sound field based on the at least one audio signal, the at least one spatial audio parameter and the at least one coherence parameter.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
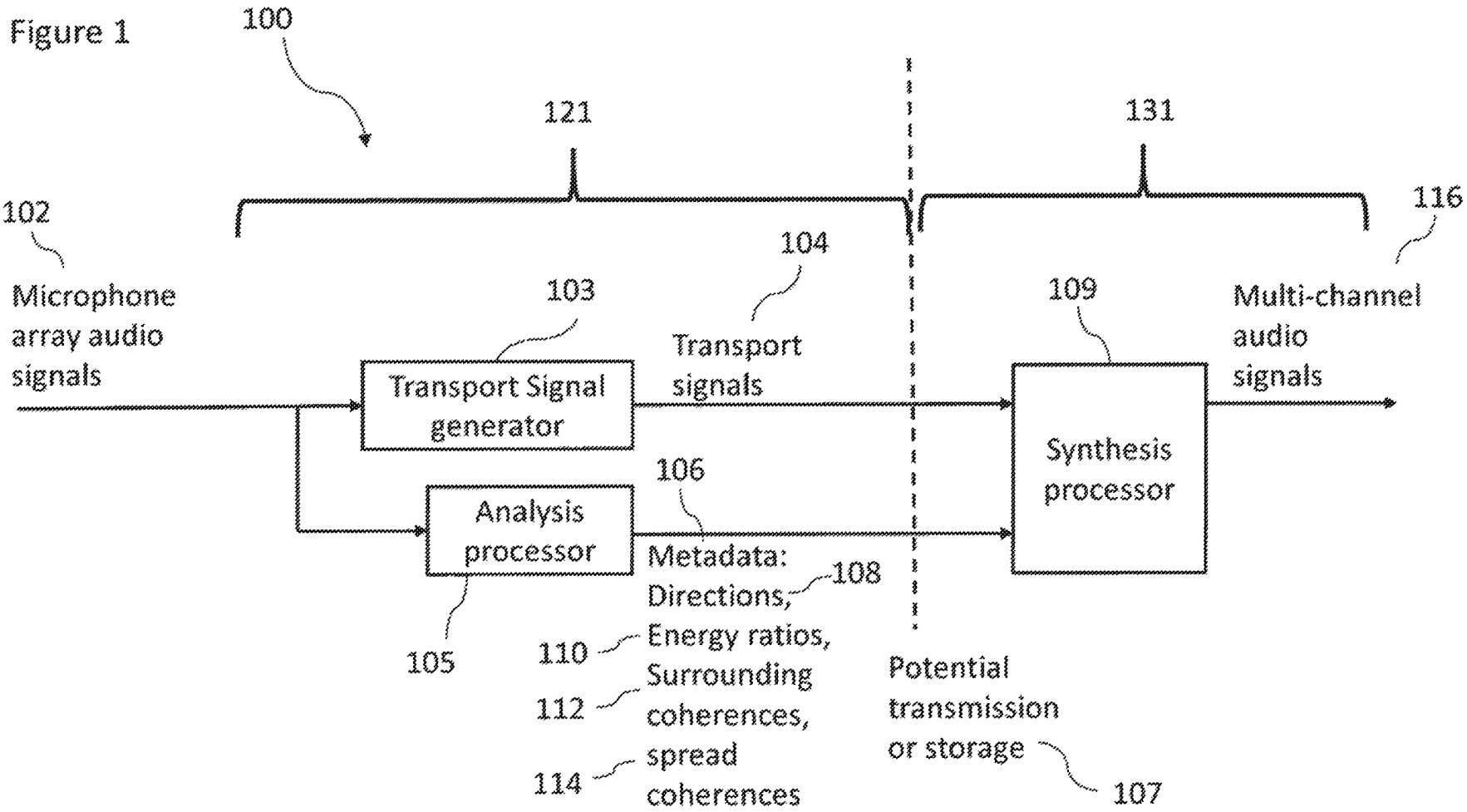
FIG. 1 shows schematically a system of apparatus suitable for implementing some embodiments.

The following describes in further detail suitable apparatus and possible mechanisms for the provision of effective spatial analysis derived metadata parameters for microphone array input format audio signals.

The concepts as expressed in the embodiments hereafter is a system in which the reproduced sound scene is as closely resembling the original input sound scene and avoids the surrounding coherent (close, pressurized) sound being reproduced as far-away ambience, and the amplitude-panned sound being reproduced as a point source.

Furthermore, some embodiments enable the microphone array to be a virtual set of microphone beam patterns. For example a first-order Ambisonics (FOA) "capture" of a set of loudspeaker and/or audio object signals. The virtual microphones may be such that they Such systems comprising the real or virtual microphone arrays in the embodiments as described herein are able to produce efficient representations of the sound scene and provide quality spatial audio capture performance so that the perception of the reproduced audio matches the perception of the original sound field (e.g., surrounding coherent sound is reproduced as surrounding coherent sound, and spread coherent sound is reproduced as spread coherent sound).

Furthermore some embodiments as described herein may be able to identify when audio is being captured in anechoic (or at least dry) space and produce efficient representations of such sound scenes. The synthesis stages for some embodiments furthermore may comprise a suitable receiver or decoder able to attempt to recreate the perception of the sound field based on the analysed parameters and the obtained transport audio signals (e.g., the anechoic sound scene is reproduced in a way that it is perceived as anechoic). This may include processing some parts of audio without decorrelation in order to avoid artefacts The reproduction of sounds coherently and simultaneously from multiple directions generates a perception that differs from the perception created by a single loudspeaker. For example, if the sound is reproduced coherently using the front left and right loudspeakers the sound can be perceived to be more "airy" than if the sound is only reproduced using the centre loudspeaker. Correspondingly, if the sound is reproduced coherently from front left, right, and centre loudspeakers, the sound may be described as being close or pressurized. Thus, the spatially coherent sound reproduction serves artistic purposes, such as adding presence for certain sounds (e.g., the lead singer sound). The coherent reproduction from several loudspeakers is sometimes also utilized for emphasizing low-frequency content.

The concept as discussed in further detail hereafter is the provision of methods and means to determine the spatial coherence by adding specific analysis methods for a microphone array audio input and to provide an added related (at least one coherence) parameter in the metadata stream which can be provided along with other spatial metadata. In this disclosure the microphone audio signals may be real microphone audio signals captured by physical microphones, for example from a microphone array. Also in some embodiments the microphone audio signals may be virtual microphone audio signals for example generated synthetically. In some embodiments the virtual microphones may be determined to have the directional capture patterns corresponding to Ambisonic beam patterns, such as the FOA beam patterns.

As such the concepts as discussed in further detail with example implementations relate to audio encoding and decoding using a spatial audio or sound-field related parameterization (for example other spatial metadata parameters may include direction(s), energy ratio(s), direct-to-total ratio(s), directional stability or other suitable parameter). The concept furthermore discloses a methods and apparatus provided to improve the reproduction quality of audio signals encoded with the aforementioned parameterization. The concept embodiments improve the quality of reproduction of the microphone audio signals by analysing the input audio signals and determining at least one coherence parameter. The term coherence or cross-correlation here is not interpreted strictly as one specific similarity value between signals, such as the normalised, square-value but reflects similarity values between playback audio signals in general and may be complex (with phase), absolute, normalised, or square values. The coherence parameter may be expressed more generally as an audio signal relationship parameter indicating a similarity of audio signals in any way.

The coherence of the output signals may refer to coherence of the reproduced loudspeaker signals, or of the reproduced binaural signals, or of the reproduced Ambisonic signals.

The coherence parameter may in some embodiments be also known as a non-reverberant sound parameter as in some embodiments the coherence parameter is determined based on a non-reverberant estimator caused to estimate a portion of non-reverberant sound from the (real or virtual) microphone array audio signals and estimate the portion non-reverberant sound.

The discussed concept implementations therefore may provide two related solutions to two related issues:

spatial coherence spanning an area in certain direction, which relates to the directional part of the sound energy;

surrounding spatial coherence, which relates to the ambient/non-directional part of the sound energy.

In some embodiments the method may comprise estimating whether the (actually or virtually) sound field has contained spatially separated coherent sound sources (e.g., the loudspeakers of a PA system). This can be estimated, e.g., by obtaining zeroth and first order spherical harmonics, and comparing the energy the zeroth and the first order harmonics. This yields a general coherence estimate, which is converted to the spread and surrounding coherence parameters based on the energy ratio parameter.

In some embodiments the method may comprise estimating whether the non-directional part of audio should be reproduced incoherent or coherent. This information can be obtained in multiple ways. As an example, it can be obtained by analysing the input microphone signals. E.g., if the microphone signals are analysed to be anechoic, the surrounding coherence parameter can be set to a large value. As another example, this information may be obtained visually. E.g., if visual depth maps show that the sound sources are very close, and all the reflecting sources are far away, it can be estimated that the input audio signals are dominantly anechoic, and thus the surrounding coherence parameter should be set to a large value. The spread coherence parameter can be left unmodified (e.g., zero) in this method.

Moreover, the ratio parameter may as discussed in further detail hereafter be modified based on the determined spatial coherence or audio signal relationship parameter(s) for further audio quality improvement.

With respect to FIG. 1 an example apparatus and system for implementing embodiments of the application are shown. The system 100 is shown with an 'analysis' part 121 and a 'synthesis' part 131. The 'analysis' part 121 is the part from receiving the microphone array audio signals up to an encoding of the metadata and transport signal and the 'synthesis' part 131 is the part from a decoding of the encoded metadata and transport signal to the presentation of the re-generated signal (for example in multi-channel loudspeaker form).

The input to the system 100 and the 'analysis' part 121 is the microphone array audio signals 102. The microphone array audio signals may be obtained from any suitable capture device and which may be local or remote from the example apparatus, or virtual microphone recordings obtained from for example loudspeaker signals. For example in some embodiments the analysis part 121 is integrated on a suitable capture device.

The microphone array audio signals are passed to a transport signal generator 103 and to an analysis processor 105.

In some embodiments the transport signal generator 103 is configured to receive the microphone array audio signals and generate suitable transport signals 104. The transport audio signals may also be known as associated audio signals and be based on the spatial audio signals which contains directional information of a sound field and which is input to the system. For example in some embodiments the transport signal generator 103 is configured to downmix or otherwise select or combine, for example, by beamforming techniques the microphone array audio signals to a determined number of channels and output these as transport signals 104. The transport signal generator 103 may be configured to generate a 2 audio channel output of the microphone array audio signals. The determined number of channels may be any suitable number of channels. In some embodiments the transport signal generator 103 is optional and the microphone array audio signals are passed unprocessed to an encoder in the same manner as the transport signals. In some embodiments the transport signal generator 103 is configured to select one or more of the microphone audio signals and output the selection as the transport signals 104. In some embodiments the transport signal generator 103 is configured to apply any suitable encoding or quantization to the microphone array audio signals or processed or selected form of the microphone array audio signals.

In some embodiments the analysis processor 105 is also configured to receive the microphone array audio signals and analyse the signals to produce metadata 106 associated with the microphone array audio signals and thus associated with the transport signals 104. The analysis processor 105 can, for example, be a computer (running suitable software stored on memory and on at least one processor), or alternatively a specific device utilizing, for example, FPGAs or ASICs. As shown herein in further detail the metadata may comprise, for each time-frequency analysis interval, a direction parameter 108, an energy ratio parameter 110, a surrounding coherence parameter 112, and a spread coherence parameter 114. The direction parameter and the energy ratio parameters may in some embodiments be considered to be spatial audio parameters. In other words the spatial audio parameters comprise parameters which aim to characterize the sound-field captured by the microphone array audio signals.

In some embodiments the parameters generated may differ from frequency band to frequency band. Thus for example in band X all of the parameters are generated and transmitted, whereas in band Y only one of the parameters is generated and transmitted, and furthermore in band Z no parameters are generated or transmitted. A practical example of this may be that for some frequency bands such as the highest band some of the parameters are not required for perceptual reasons. The transport signals 104 and the metadata 106 may be transmitted or stored, this is shown in FIG. 1 by the dashed line 107. Before the transport signals 104 and the metadata 106 are transmitted or stored they are typically coded in order to reduce bit rate, and multiplexed to one stream. The encoding and the multiplexing may be implemented using any suitable scheme.

In the decoder side, the received or retrieved data (stream) may be demultiplexed, and the coded streams decoded in order to obtain the transport signals and the metadata. This receiving or retrieving of the transport signals and the metadata is also shown in FIG. 1 with respect to the right hand side of the dashed line 107.

The system 100 'synthesis' part 131 shows a synthesis processor 109 configured to receive the transport signals 104 and the metadata 106 and creates a suitable multi-channel audio signal output 116 (which may be any suitable output format such as binaural, multi-channel loudspeaker or Ambisonics signals, depending on the use case) based on the transport signals 104 and the metadata 106. In some embodiments with loudspeaker reproduction, an actual physical sound field is reproduced (using the loudspeakers) having the desired perceptual properties. In other embodiments, the reproduction of a sound field may be understood to refer to reproducing perceptual properties of a sound field by other means than reproducing an actual physical sound field in a space. For example, the desired perceptual properties of a sound field can be reproduced over headphones using the binaural reproduction methods as described herein. In another example, the perceptual properties of a sound field could be reproduced as an Ambisonic output signal, and these Ambisonic signals can be reproduced with Ambisonic decoding methods to provide for example a binaural output with the desired perceptual properties.

The synthesis processor 109 can in some embodiments be a computer (running suitable software stored on memory and on at least one processor), or alternatively a specific device utilizing, for example, FPGAs or ASICs.

Figure 2:
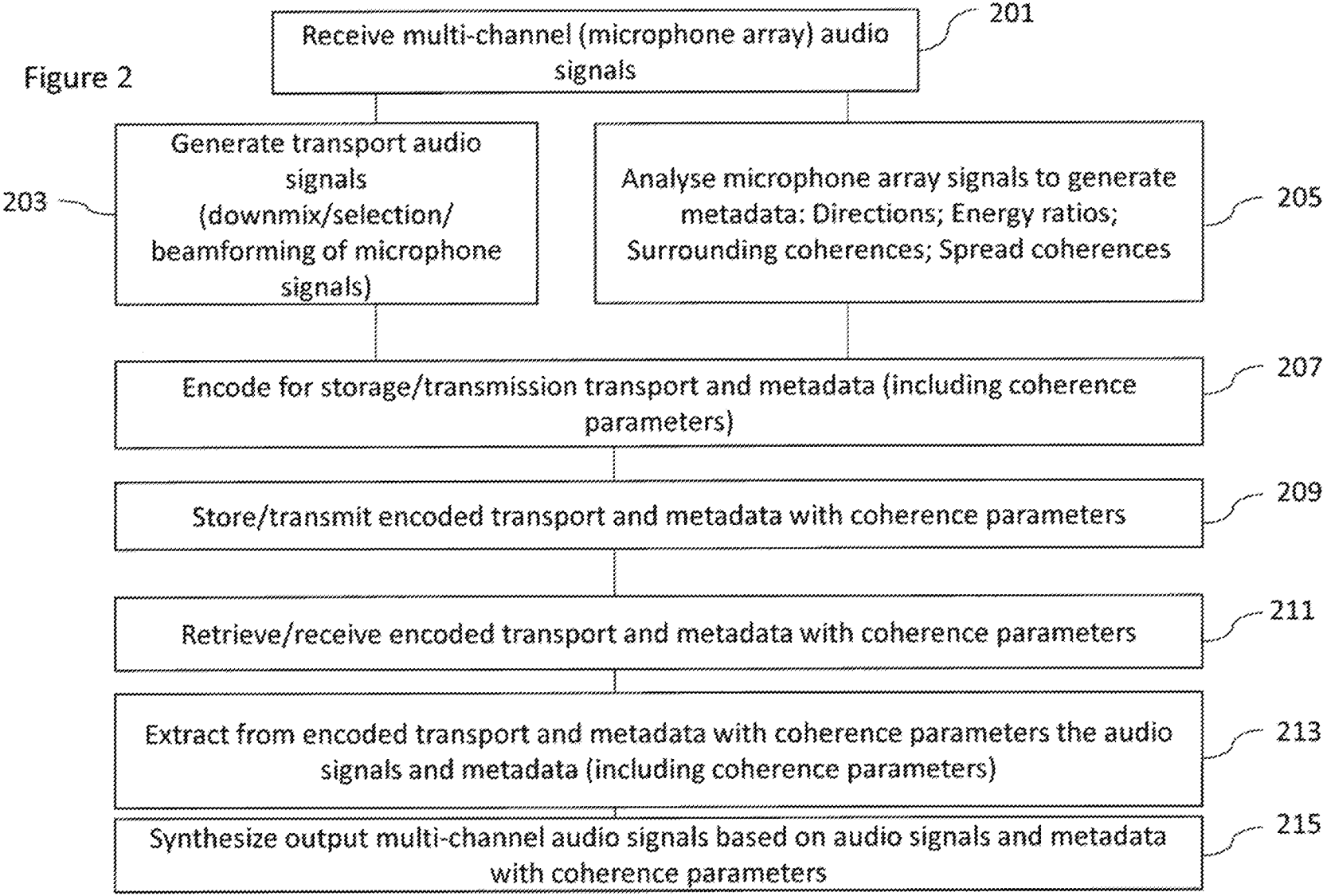
FIG. 2 shows a flow diagram of the operation of the system as shown in FIG. 1 according to some embodiments.

With respect to FIG. 2 an example flow diagram of the overview shown in FIG. 1 is shown.

First the system (analysis part) is configured to receive microphone array audio signals as shown in FIG. 2 by step 201.

Then the system (analysis part) is configured to generate a transport signal (for example downmix/selection/beamforming based on microphone array audio signals) as shown in FIG. 2 by step 203.

Also the system (analysis part) is configured to analyse the microphone array audio signals to generate metadata: Directions; Energy ratios; Surrounding coherences; Spread coherences as shown in FIG. 2 by step 205.

The system is then configured to (optionally) encode for storage/transmission the transport signal and metadata with coherence parameters as shown in FIG. 2 by step 207.

After this the system may store/transmit the transport signals and metadata with coherence parameters as shown in FIG. 2 by step 209.

The system may retrieve/receive the transport signals and metadata with coherence parameters as shown in FIG. 2 by step 211.

Then the system is configured to extract from the transport signals and metadata with coherence parameters as shown in FIG. 2 by step 213.

The system (synthesis part) is configured to synthesize an output multi-channel audio signal (which as discussed earlier may be any suitable output format such as binaural, multi-channel loudspeaker or Ambisonics signals, depending on the use case) based on extracted audio signals and metadata with coherence parameters as shown in FIG. 2 by step 215.

Figure 3:
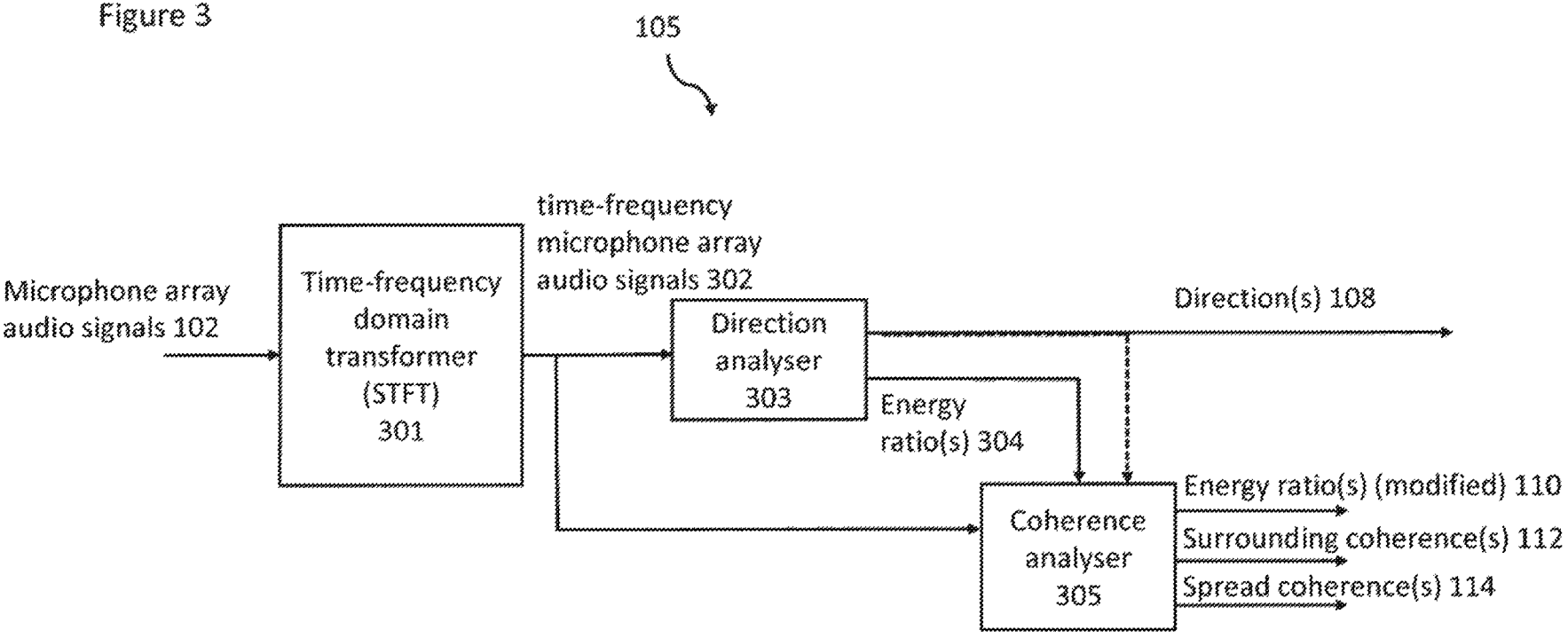
FIG. 3 shows schematically the analysis processor as shown in FIG. 1 according to some embodiments.

With respect to FIG. 3 an example analysis processor 105 (as shown in FIG. 1) according to some embodiments is described in further detail. The analysis processor 105 in some embodiments comprises a time-frequency domain transformer 301.

In some embodiments the time-frequency domain transformer 301 is configured to receive the microphone array audio signals 102 and apply a suitable time to frequency domain transform such as a Short Time Fourier Transform (STFT) in order to convert the input time domain signals into a suitable time-frequency signals. These time-frequency signals may be passed to a direction analyser 303 and to a coherence analyser 305.

Thus for example the time-frequency signals 302 may be represented in the time-frequency domain representation by $$s_i(b,n),$$

where b is the frequency bin index and n is the frame index and i is the microphone index. In another expression, n can be considered as a time index with a lower sampling rate than that of the original time-domain signals. These frequency bins can be grouped into subbands that group one or more of the bins into a band index k=0, . . . , K−1. Each subband k has a lowest bin $b_{k,low}$ and a highest bin $b_{k,high}$, and the subband contains all bins from $b_{k,low}$ to $b_{k,high}$. The widths of the subbands can approximate any suitable distribution. For example the Equivalent rectangular bandwidth (ERB) scale or the Bark scale.

In some embodiments the analysis processor 105 comprises a direction analyser 303. The direction analyser 303 may be configured to receive the time-frequency signals 302 and based on these signals estimate direction parameters 108. The direction parameters may be determined based on any audio based 'direction' determination.

For example in some embodiments the direction analyser 303 is configured to estimate the direction with two or more microphone signal inputs. This represents the simplest configuration to estimate a 'direction', more complex processing may be performed with even more microphone signals.

The direction analyser 303 may thus be configured to provide an azimuth for each frequency band and temporal frame, denoted as $\theta(k,n)$. Where the direction parameter is a 3D parameter an example direction parameter may be azimuth $\theta(k,n)$, elevation $\varphi(k,n)$. The direction parameter 108 may be also be passed to a coherence analyser 305 as indicated by the dotted line.

In some embodiments further to the direction parameter the direction analyser 303 is configured to determine other suitable parameters which are associated with the determined direction parameter. For example in some embodiments the direction analyser is caused to determine an energy ratio parameter 304. The energy ratio may be considered to be a determination of the energy of the audio signal which can be considered to arrive from a direction. The (direct-to-total) energy ratio $r(k,n)$ can for example be estimated using a stability measure of the directional estimate, or using any correlation measure, or any other suitable method to obtain an energy ratio parameter.

In other embodiments the direction analyser is caused to determine and output the stability measure of the directional estimate, a correlation measure or other direction associated parameter.

The estimated direction 108 parameters may be output (and to be used in the synthesis processor). The estimated energy ratio parameters 304 may be passed to a coherence analyser 305. The parameters may, in some embodiments, be received in a parameter combiner (not shown) where the estimated direction and energy ratio parameters are combined with the coherence parameters as generated by the coherence analyser 305 described hereafter.

In some embodiments the analysis processor 105 comprises a coherence analyser 305. The coherence analyser 305 is configured to receive parameters (such as the azimuths ($\theta(k,n)$) 108, and the direct-to-total energy ratios ($r(k,n)$) 304) from the direction analyser 303. The coherence analyser 305 may be further configured to receive the time-frequency signals ($s_i(b,n)$) 302 from the time-frequency domain transformer 301. All of these are in the time-frequency domain; b is the frequency bin index, k is the frequency band index (each band potentially consists of several bins b), n is the time index, and i is the microphone index.

Although directions and ratios are here expressed for each time index n, in some embodiments the parameters may be combined over several time indices. Same applies for the frequency axis, as has been expressed, the direction of several frequency bins b could be expressed by one direction parameter in band k consisting of several frequency bins b. The same applies for all of the discussed spatial parameters herein.

The coherence analyser 305 is configured to produce a number of coherence parameters. In the following disclosure there are the two parameters: surrounding coherence ($\gamma(k,n)$) and spread coherence ($\zeta(k,n)$), both analysed in time-frequency domain. In addition, in some embodiments the coherence analyser 305 is configured to modify the estimated energy ratios ($r(k,n)$). This modified energy ratio $r'$ can be used to replace the original energy ratio r.

Each of the aforementioned spatial coherence issues related to the direction-ratio parameterization are next discussed, and it is shown how the aforementioned new parameters are formed in each of the cases. All the processing is performed in the time-frequency domain, so the time-frequency indices k and n are dropped where necessary for brevity. As stated previously, in some cases the spatial metadata may be expressed in another frequency resolution than the frequency resolution of the time-frequency signal.

These (modified) energy ratios 110, surrounding coherence 112 and spread coherence 114 parameters may then be output. As discussed these parameters may be passed to a metadata combiner or be processed in any suitable manner, for example encoding and/or multiplexing with the transport signals and stored and/or transmitted (and be passed to the synthesis part of the system).

Figure 4:
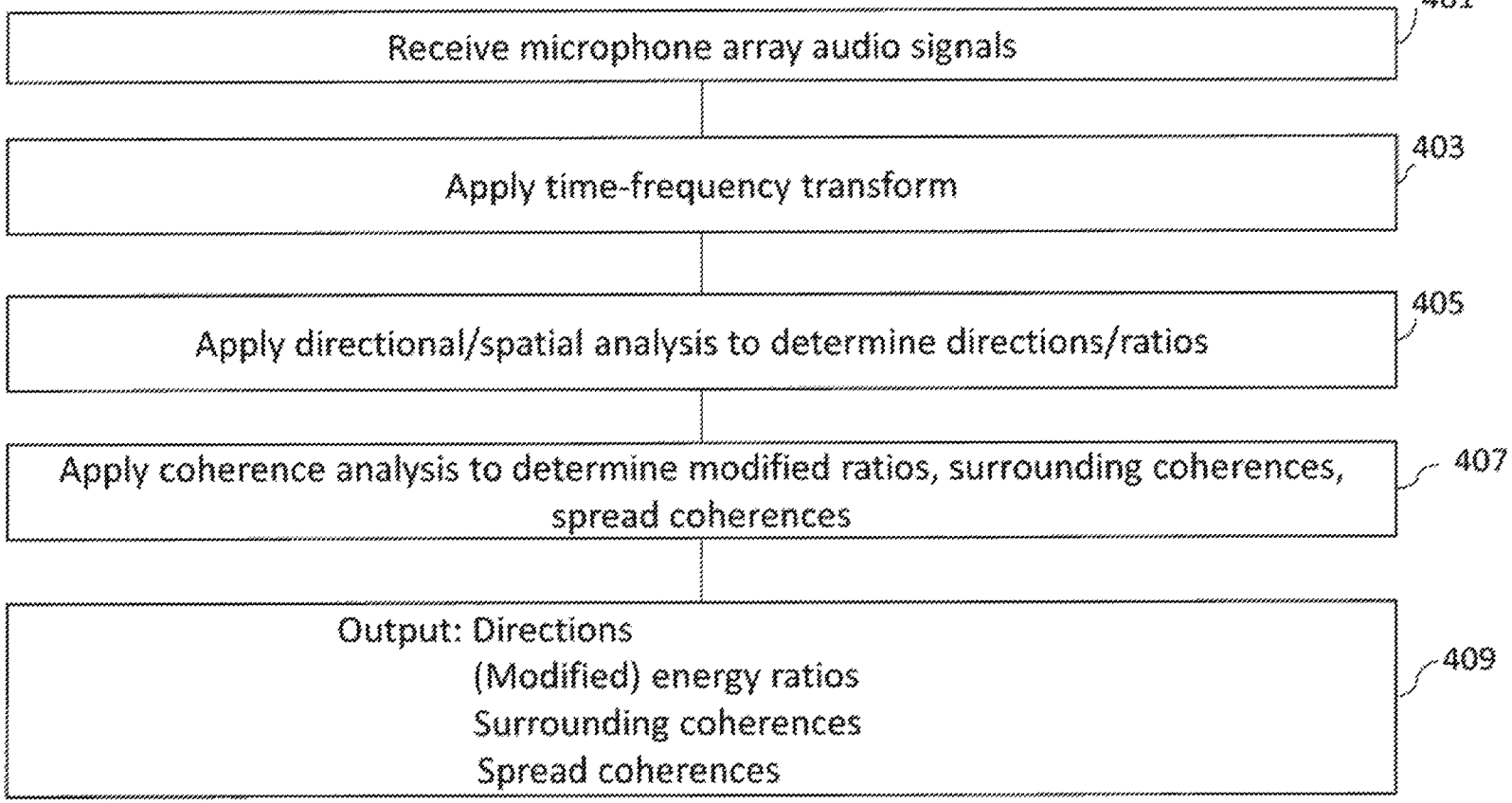
FIG. 4 shows a flow diagram of the operation of the analysis processor as shown in FIG. 3 according to some embodiments.

With respect to FIG. 4 is shown a flow diagram summarising the operations with respect to the analysis processor 105.

The first operation is one of receiving time domain microphone array audio signals as shown in FIG. 4 by step 401.

Following this is applying a time domain to frequency domain transform (e.g. STFT) to generate suitable time-frequency domain signals for analysis as shown in FIG. 4 by step 403.

Then applying directional/spatial analysis to the microphone array audio signals determine direction and energy ratio parameters is shown in FIG. 4 by step 405.

Then applying coherence analysis to the microphone array audio signals to determine coherence parameters such as surrounding and/or spread coherence parameters is shown in FIG. 4 by step 407.

In some embodiments the energy ratio may also be modified based on the determined coherence parameters in this step.

The final operation being one of outputting the determined parameters is shown in FIG. 4 by step 409.

Figure 5:
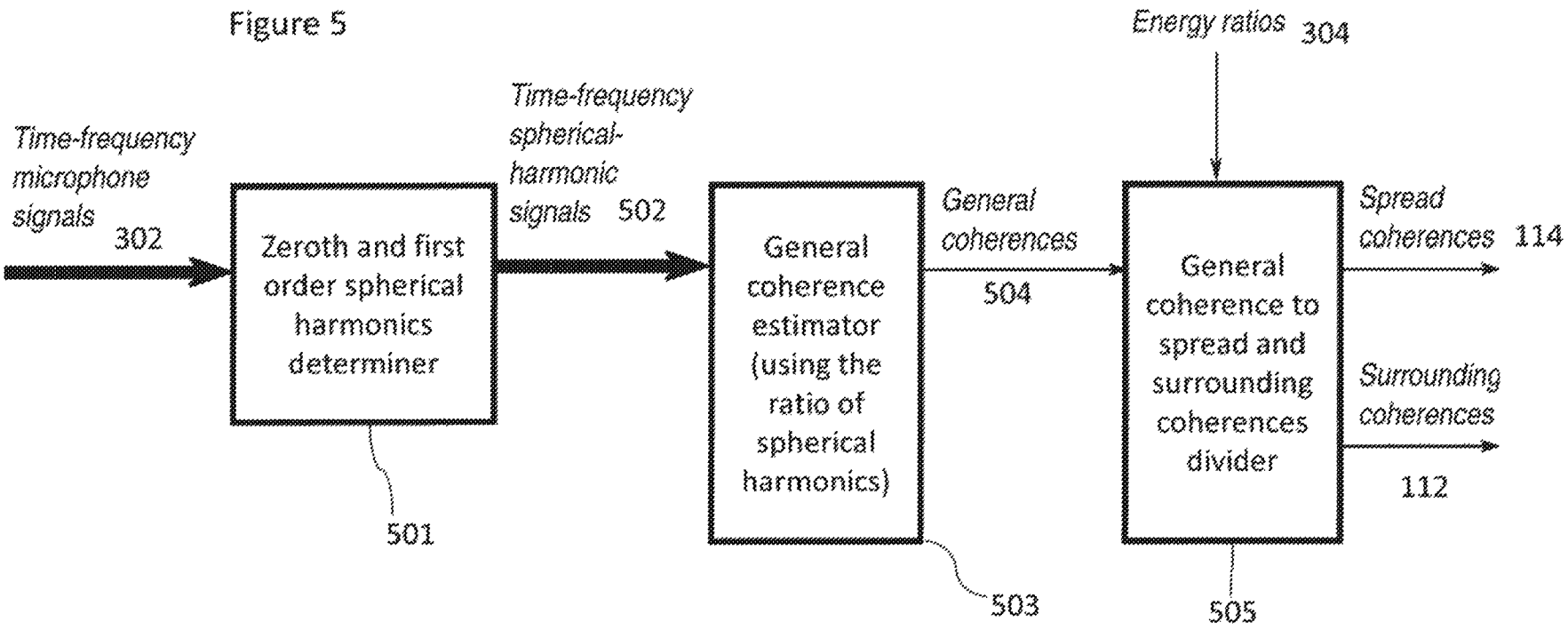
FIG. 5 shows an example coherence analyser according to some embodiments.

With respect to FIG. 5 is shown a first example of a coherence analyser according to some embodiments.

The first example implements methods for determining spatial coherence utilizing a first-order Ambisonics (FOA) signal, which can be generated with some microphone arrays (at least for a defined frequency range). Alternatively, the FOA signal can be generated virtually from other audio signal formats, for example loudspeaker input signals. The following methods estimate the spread and surround coherence occurring in the sound field. An example microphone array providing a FOA signal is a B-format microphone providing the omnidirectional signal and the three dipole signals.

Note that in case the FOA signal is generated virtually (in other words for example converted from a loudspeaker format) then the input signal to the coherence analyser is a FOA signal, which is then transformed to the time-frequency domain for the direction and coherence analysis.

A zeroth and first order spherical harmonics determiner 501 may be configured to receive the time-frequency microphone audio signals 302 and generate suitable time-frequency spherical-harmonic signals 502.

A general coherence estimator 503 may be configured to receive the time-frequency spherical-harmonic signals 502

(which may be either captured at a sound field with spatially separated coherent sound sources or generated by the zeroth and first order spherical harmonics determiner 501), a general coherence parameter μ(k,n) can be generated by monitoring the energies of the FOA components.

If any microphone being able to produce a FOA signal is placed in a diffuse field, the energies of the three dipole signals X, Y, Z have the same sum energy as the omnidirectional component W (according to the Schmidt semi-normalisation (SN3D) gain balance between W and X, Y, Z). However, if the sound is reproduced coherently at spatially separated loudspeakers, the energy of the X,Y,Z signals becomes smaller (or even zero), since the X, Y, Z patterns have positive amplitude to one direction, and a negative amplitude to the other direction, and thus signal cancellation occurs for spatially separated coherent sound sources.

By generating and monitoring surround signals, coherent to incoherent, it is possible to determine a formula providing estimates for the general coherence parameter μ based on the energy information of the FOA signal.

Let us denote $c_{a,b}$ as the (a,b) entry of the estimated covariance matrix of the FOA signal (W,X,Y,Z), and the general coherence parameter μ can be estimated by $$\mu = \max\left[1 - \left(\frac{c_{2,2} + c_{3,3} + c_{4,4}}{c_{1,1}}\right)^{p}, 0\right]$$

where the time-frequency indices were omitted. Coefficient μ may, e.g., have the value of 1.

The general coherence to spread and surrounding coherences divider 505 is configured to receive the generated general coherences 504 and the energy ratios 304 and generate estimates of the spread and the surrounding coherence parameters based on this general coherence parameter.

In some embodiments the general coherence can be divided into the spread and surrounding coherences using the energy ratio. Thus for example the spread and surrounding coherences can be estimated as:

$$\zeta(k,n)=r(k,n)\mu(k,n)$$

$$\gamma(k,n)=(1-r(k,n))\mu(k,n)$$

Where ζ is the spread coherence parameter 114 and γ is the surrounding coherence parameter 112 and r the energy ratio. In practice, if the direct-to-total energy ratio is large, the general coherence is transformed to spread coherence, and if the direct-total energy is small, the general coherence is transformed to surrounding coherence.

In some embodiments the general coherence to spread and surrounding coherences divider 505 is configured to simply set both spread and surround coherence parameters to the general coherence parameter.

Figure 6:
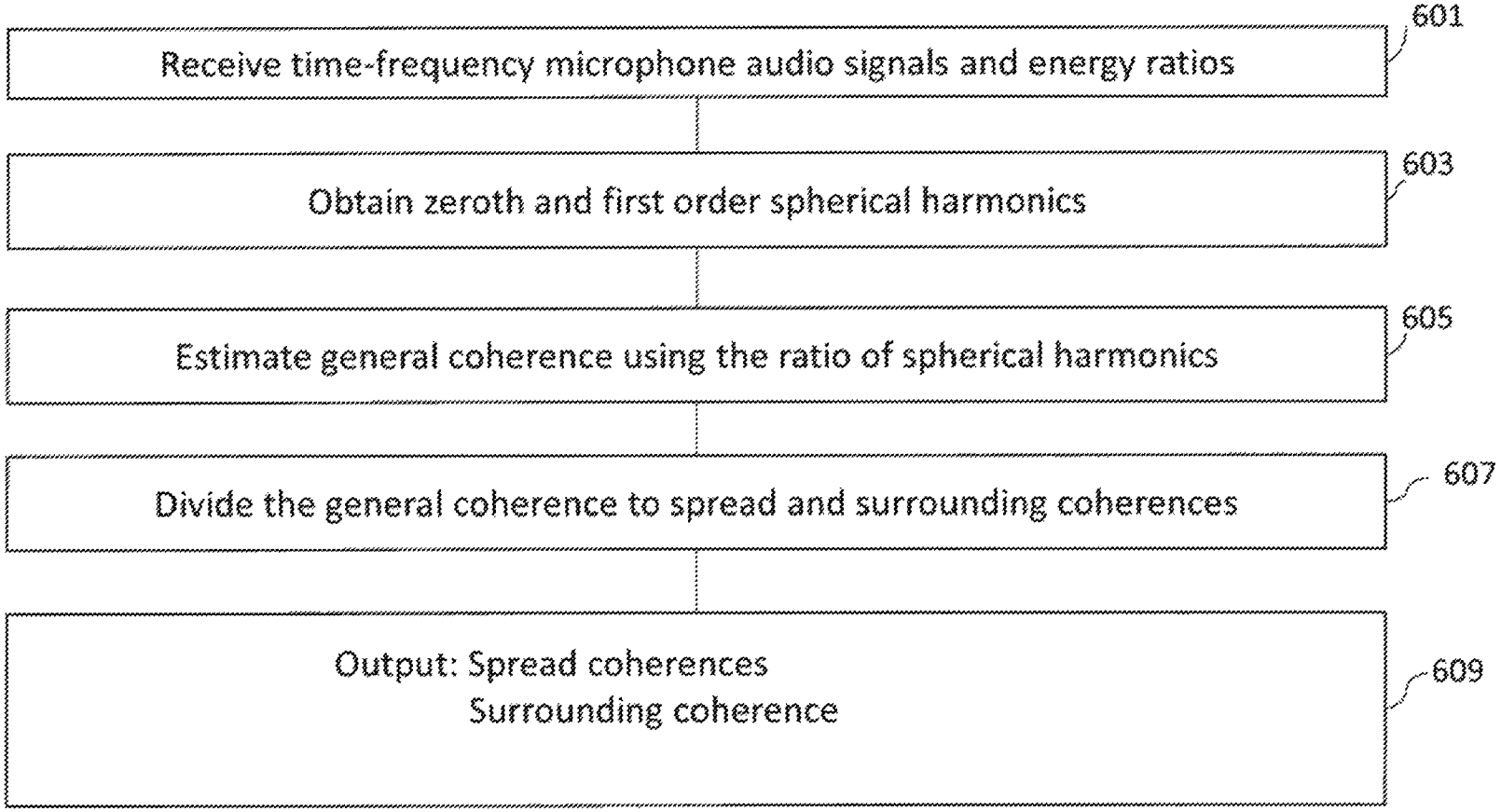
FIG. 6 shows a flow diagram of the operation of the example coherence analyser as shown in FIG. 5 according to some embodiments.

With respect to FIG. 6 a flow diagram summarising the operations with respect to the first example coherence analyser as shown in FIG. 5 is shown.

The first operation is one of receiving time-frequency domain microphone array audio signals and the energy ratios as shown in FIG. 6 by step 601.

Following this is applying a suitable conversion to generate zeroth and first order spherical harmonics as shown in FIG. 6 by step 603.

Then by determining the ratio of spherical harmonics the general coherence may be estimated as shown in FIG. 6 by step 605.

Then dividing the estimated general coherence values to the spread and surrounding coherence estimates as shown in FIG. 6 by step 607.

The final operation being one of outputting the determined coherence parameters is shown in FIG. 6 by step 609.

Figure 7:
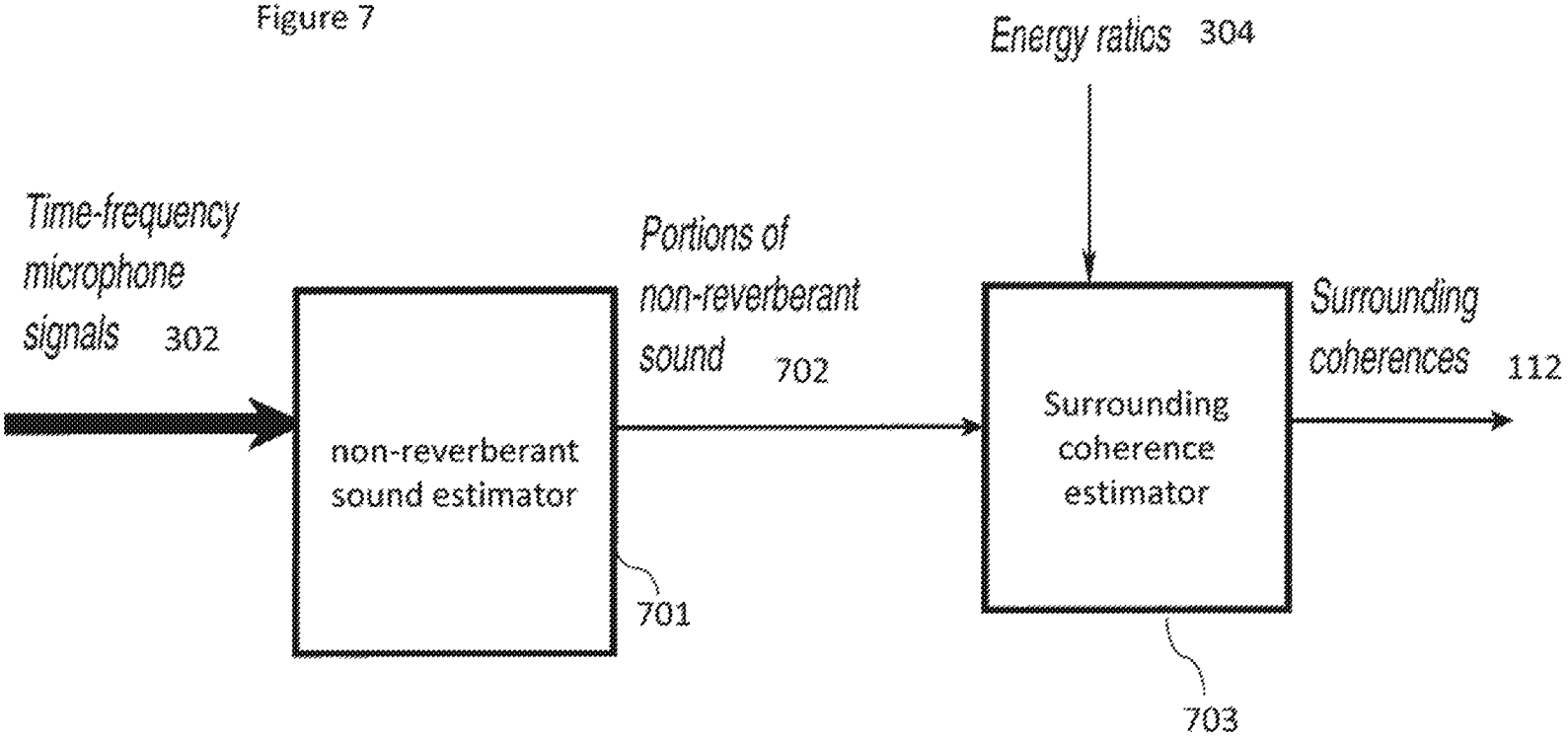
FIG. 7 shows a further example coherence analyser according to some embodiments.

A further example coherence analyser is shown with respect to FIG. 7.

These examples estimate whether the non-directional part of the audio is to be reproduced as coherent or incoherent sound for optimal audio quality. The analyser provides the surrounding coherence parameter and is applicable to any microphone array, including those not able to provide the FOA signal.

The non-reverberant sound estimator 701 is configured to receive the time-frequency microphone array audio signals and estimate the portion non-reverberant sound.

The estimation of the amount of direct sound and reverberant sound in captured microphone signals, or even extracting the direct and reverberant components from the mix can be implemented according to any known method. In some embodiments the estimate may be generated from another source than the captured audio signals. For example in some embodiments the estimation of the amount of direct sound and reverberant sound can be estimated using visual information. For example if visual depth maps show that the sound sources are very close, and all the reflecting sources are far away, it can be estimated that the input audio signals are dominantly anechoic (and thus the surrounding coherence parameter should be set to a large value). In some embodiments a user may even manually select an estimate.

An example method for the analysis of the microphone audio signals to determine the estimate of the direct sound component may be obtained using spectral subtraction $$D(k,n)=S(k,n)-R(k,n)$$

where D is the estimated direct sound energy component, S is the estimated total signal energy (can be estimated, e.g., from any of the microphones signals, e.g., $S=E[s^2]$; or a mix of them), and R is the estimated reverberant sound energy component. The estimate for R is obtained by filtering the estimated direct sound energy component D with estimated decaying coefficients. The decaying coefficient themselves can be estimated, e.g., using blind reverberation time estimation methods.

Using the estimated direct sound component D, the portion of the direct sound in the captured microphone signals can be estimated $$d(k,n) = \frac{D(k,n)}{S(k,n)}$$

The estimated energy values S(k,n) etc., may have been averaged over several time and or frequency indices (k,n).

If the non-directional audio is mostly reverberation, reproducing it as incoherent is optimal, since having incoherence is required in order to reproduce the perception of envelopment and spaciousness that are natural for reverberation, and the typically required decorrelation does not deteriorate the audio quality in the case of reverberation. If the non-directional audio is mostly non-reverberation, reproducing it as coherent is desired, since incoherence is not necessary with such sounds, whereas the decorrelation can deteriorate the audio quality (especially in the case of speech signals). Hence, the selection of coherence/incoherent reproduction of the non-directional audio may be guided based on the analysed reverberance of it.

A surrounding coherence estimator 703 may receive the estimation of the non-reverberant sound portion 702 and the energy ratio 304 and estimate the surrounding coherences 112. The directional part of the captured microphone signals, defined by the energy ratio r, can be approximated to be only direct sound. The ambient part of the signal, defined by 1−r, can be approximated to be a mix of reverberation, ambient sounds, and direct sound during double talk.

If the ambient part contains only reverberation and ambient sounds, the surrounding coherence γ should be set to 0 (these should be reproduced as incoherent). However, if the ambient part contains only direct sound during double talk, the surrounding coherence γ should be set to 1 (this should be reproduced as coherent in order to avoid decorrelation). Using these principles, an equation for the surrounding coherence γ can, e.g., be formed as $$\gamma(k, n) = \max\left(\frac{d(k, n) - r(k, n)}{1 - r(k, n)}, 0\right)$$

The spread coherence ζ(k,n) may be set to zero in this method.

Figure 8:
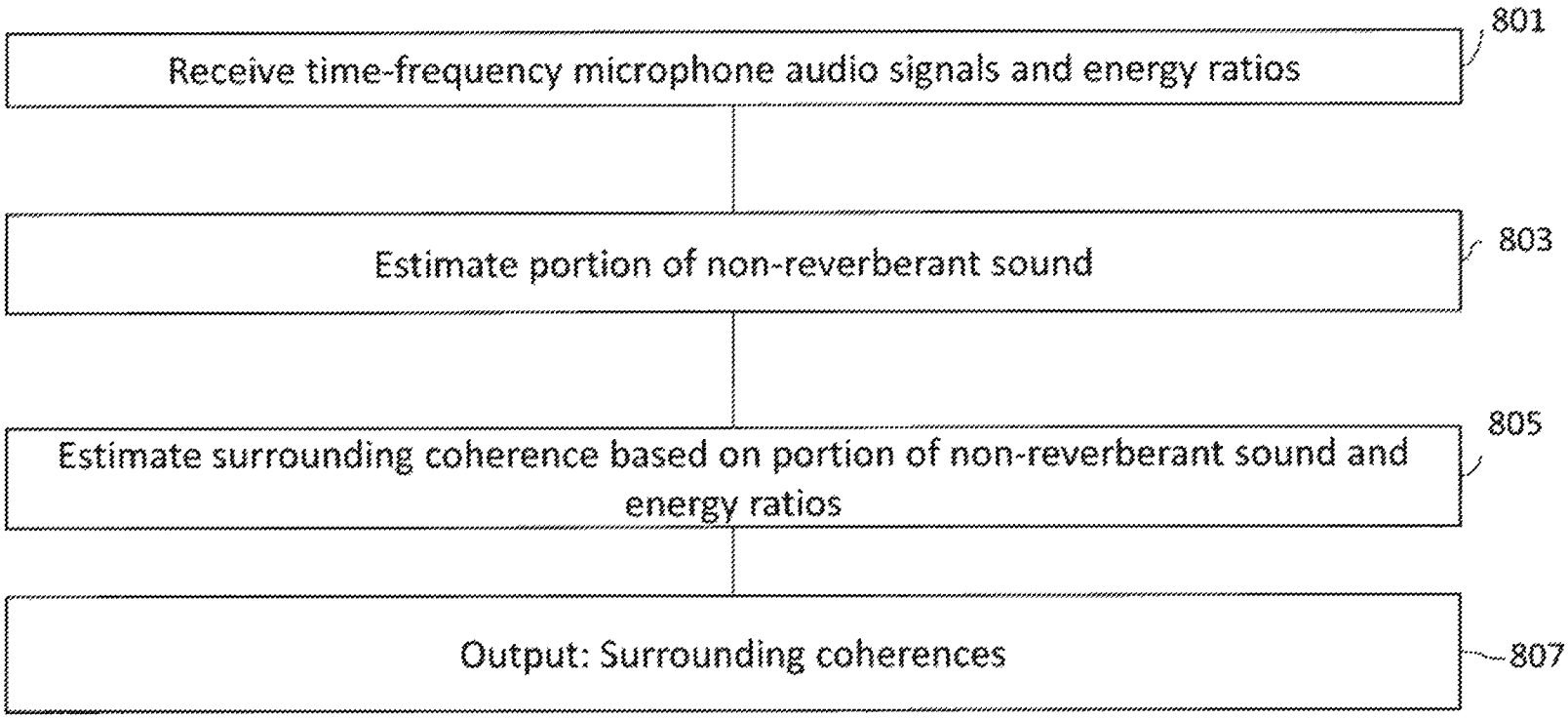
FIG. 8 shows a flow diagram of the operation of the further example coherence analyser as shown in FIG. 7 according to some embodiments.

With respect to FIG. 8 a flow diagram summarising the operations with respect to the second example coherence analyser as shown in FIG. 7 is shown.

The first operation is one of receiving time-frequency domain microphone array audio signals and the energy ratios as shown in FIG. 8 by step 801.

Following this is estimating the portion of non-reverberant sound as shown in FIG. 8 by step 803.

Then estimating surrounding coherence based on portion of non-reverberant sound and energy ratios as shown in FIG. 8 by step 805.

The final operation being one of outputting the determined coherence parameters is shown in FIG. 8 by step 807.

In some embodiments both coherence analysers may be implemented and the outputs merged. The merging may for example be realized by taking the maximum of the two estimates $$\zeta(k,n)=\max(\zeta_1(k,n),\zeta_2(k,n)),$$

$$\gamma(k,n)=\max(\gamma_1(k,n),\gamma_2(k,n)).$$

Figure 9:
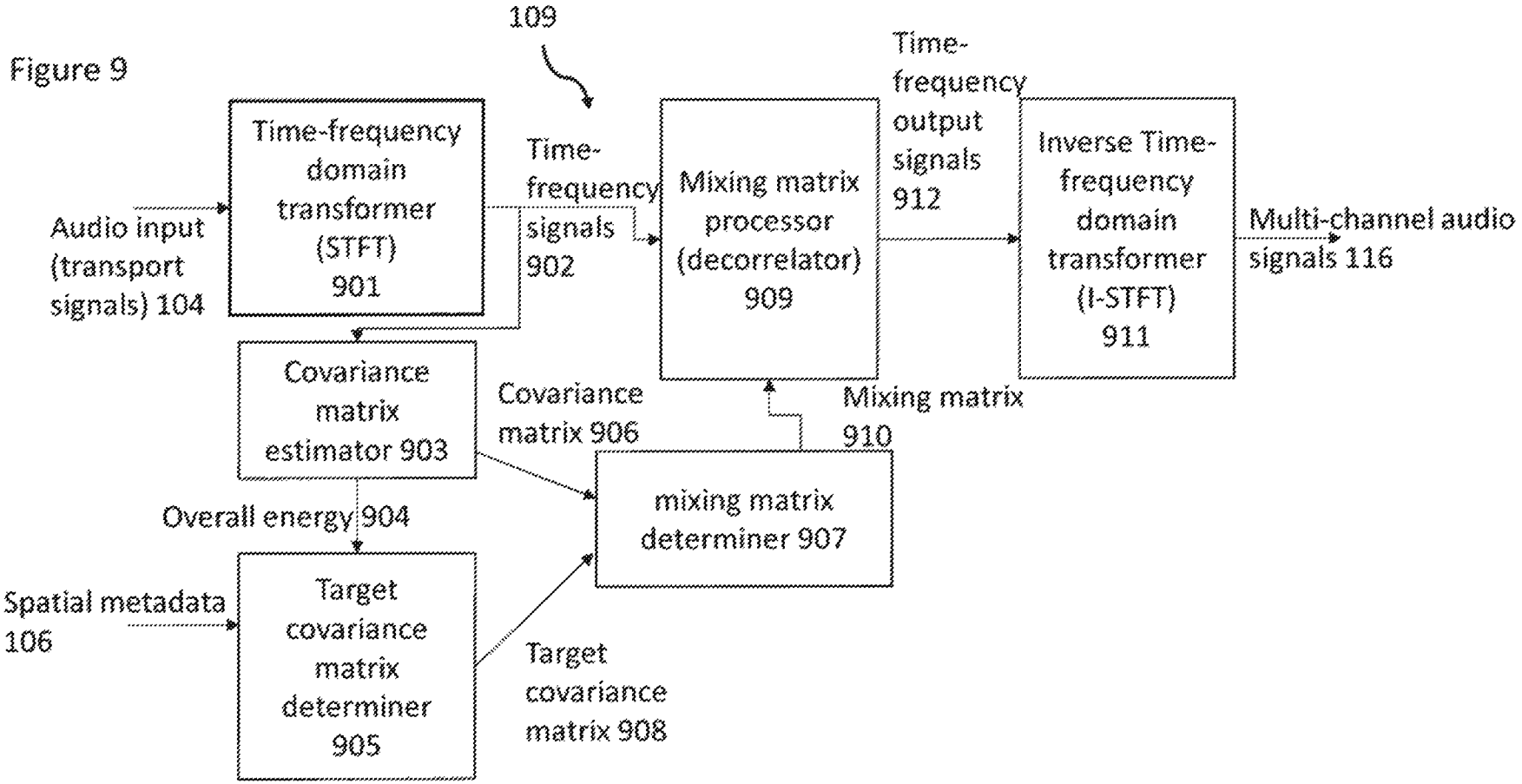
FIG. 9 shows an example synthesis processor as shown in FIG. 1 according to some embodiments.

With respect to FIG. 9, an example synthesis processor 109 is shown in further detail. The example synthesis processor 109 may be configured to utilize a modified method according to any known method, for example a method which is particularly suited for such cases where the inter-channel signal coherences require to be synthesized or manipulated.

The synthesis method may be a modified least-squares optimized signal mixing technique to manipulate the covariance matrix of a signal, while attempting to preserve audio quality. The method utilizes the covariance matrix measure of the input signal and a target covariance matrix (as discussed below), and provides a mixing matrix to perform such processing. The method also provides means to optimally utilize decorrelated sound when there is no sufficient amount of independent signal energy at the inputs.

The synthesis processor 109 may comprise a time-frequency domain transformer 901 configured to receive the audio input in the form of transport signals 104 and apply a suitable time to frequency domain transform such as a Short Time Fourier Transform (STFT) in order to convert the input time domain signals into a suitable time-frequency signals. These time-frequency signals may be passed to a mixing matrix processor 909 and covariance matrix estimator 903.

The time-frequency signals may then be processed adaptively in frequency bands with a mixing matrix processor (and potentially also decorrelation processor) 909. The output of the mixing matrix processor 909 in the form of time-frequency output signals 912 may be passed to an inverse time-frequency domain transformer 911. The inverse time-frequency domain transformer 911 (for example an inverse short time Fourier transformer or I-STFT) is configured to transform the time-frequency output signals 912 to the time domain to provide the processed output in the form of the multi-channel audio signals 116. Mixing matrix processing methods are well documented and are not described in further detail hereafter.

A mixing matrix determiner 907 may generate the mixing matrix and pass it to the mixing matrix processor 909. The mixing matrix determiner 907 may be caused to generate mixing matrices for the frequency bands. The mixing matrix determiner 907 is configured to receive input covariance matrices 906 and target covariance matrices 908 organised in frequency bands.

The covariance matrix estimator 903 may be caused to generate the covariance matrices 906 organised in frequency bands by measuring the time-frequency signals (transport signals in frequency bands) from the time-frequency domain transformer 901. These estimated covariance matrices may then be passed to the mixing matrix determiner 907.

Furthermore the covariance matrix determiner 903 may be configured to estimate the overall energy E 904 and pass this to a target covariance matrix determiner 905. The overall energy E may in some embodiments may be determined from the sum of the diagonal elements of the estimated covariance matrix.

The target covariance matrix determiner 905 is caused to generate the target covariance matrix. The target covariance matrix determiner 905 may in some embodiments determine the target covariance matrix for reproduction to surround loudspeaker setups. In the following expressions the time and frequency indices n and k are removed for simplicity (when not necessary).

First the target covariance matrix determiner 905 may be configured to receive the overall energy E 904 based on the input covariance matrix from the covariance matrix estimator 903 and furthermore the spatial metadata 106.

The target covariance matrix determiner 905 may then be configured to determine the target covariance matrix $C_T$ in mutually incoherent parts, the directional part $C_D$ and the ambient or non-directional part $C_A$.

The target covariance matrix is thus determined by the target covariance matrix determiner 905 as $C_T=C_D+C_A$.

The ambient part $C_A$ expresses the spatially surrounding sound energy, which previously has been only incoherent, but due to the present invention it may be incoherent or coherent, or partially coherent.

The target covariance matrix determiner 905 may thus be configured to determine the ambience energy as (1−r)E, where r is the direct-to-total energy ratio parameter from the input metadata. Then, the ambience covariance matrix can be determined by, $$C_A=(1-r)E((1-\gamma)I_{M\times M}+\gamma U_{M\times M})/M.$$

where I is an identity matrix and U is a matrix of ones, and M is the number of output channels. In other words, when γ is zero, then the ambience covariance matrix $C_A$ is diagonal, and when γ is one, then the ambience covariance matrix is such that determines that all channel pairs to be coherent.

The target covariance matrix determiner 905 may next be configured to determine the direct part covariance matrix $C_D$.

The target covariance matrix determiner 905 can thus be configured to determine the direct part energy as rE.

Then the target covariance matrix determiner 905 is configured to determine a gain vector for the loudspeaker signals based on the metadata. First, the target covariance matrix determiner 905 is configured to determine a vector of the amplitude panning gains based on the loudspeaker setup and the direction information of the spatial metadata, for example, using the vector base amplitude panning (VBAP). These gains can be denoted in a column vector $v_{VBAP}$, which may be implemented using any suitable virtual space polygon arrangement (typically triangular in nature and therefore defined in the following examples in terms of channel or node triplets) in three dimensional space. In some embodiments a horizontal setup has in maximum only two non-zero values for the two loudspeakers active in the amplitude panning. The target covariance matrix determiner 905 can in some embodiments be configured to determine the VBAP covariance matrix as, $$C_{VBAP}=v_{VBAP}v_{VBAPH}.$$

The target covariance matrix determiner 905 can be configured to determine the channel triplet $i_l$, $i_r$, $i_c$ which are the loudspeakers nearest to the estimated direction, and the nearest left and right loudspeakers.

The target covariance matrix determiner 905 may furthermore be configured to determine a panning column vector $v_{LRC}$ being otherwise zero, but having values $\sqrt{1/3}$ at the indices $i_l$, $i_r$, $i_c$. The covariance matrix for that vector is $$C_{LRC}=v_{LRC}v_{LRC}^H.$$

When the spread coherence parameter ζ is less than 0.5, i.e., when the sound would be reproduced between a "direct point source" scenario and a "three-loudspeakers coherent sound" scenario, the target covariance matrix determiner 305 can be configured to determine the direct part covariance matrix to be $$C_D=rE((1-2\zeta)C_{VBAP}+2\zeta C_{LRC}).$$

When the spread coherence parameter ζ is between 0.5 and 1, i.e., when the sound would be reproduced between the "three-loudspeakers coherent sound" scenario and "two spread loudspeakers coherent sound" scenario, the target covariance matrix determiner 905 can determine a spread distribution vector $$v_{DISTR,3}=\begin{bmatrix}(2-2\zeta)\\1\\1\end{bmatrix}\frac{1}{\sqrt{(2-2\zeta)^2+2}}.$$

Then the target covariance matrix determiner 905 can be configured to determine a panning vector $v_{DISTR}$ where the $i_c$th entry is the first entry of $v_{DISTR,3}$, and $i_l$th and $i_r$th entries are the second and third entries of $v_{DISTR,3}$. The direct part covariance matrix may then be calculated by the target covariance matrix determiner 905 to be, $$C_D=rE(v_{DISTR}v_{DISTR}^H).$$

The target covariance matrix determiner 905 may then obtain the target covariance matrix $C_T=C_D+C_A$ to process the sound. As expressed above, the ambience part covariance matrix thus accounts for the ambience energy and the spatial coherence contained by the surrounding coherence parameter γ, and the direct covariance matrix accounts for the directional energy, the direction parameter, and the spread coherence parameter ζ.

The target covariance matrix determiner 905 may be configured to determine a target covariance matrix 908 for a binaural output by being configured to synthesize inter-aural properties instead of inter-channel properties of surround sound.

Thus the target covariance matrix determiner 905 may be configured to determine, the ambience covariance matrix $C_A$ for the binaural sound. The amount of ambient or non-directional energy is (1−r)E, where E is the total energy as determined previously. The ambience part covariance matrix can be determined as $$C_A(k,n)=(1-r(k,n))E(k,n)\begin{bmatrix}1 & c(k,n)\\ c(k,n) & 1\end{bmatrix}, \text{ where}$$

$$c(k,n)=\gamma(k,n)+(1-\gamma(k,n))c_{bin}(k).$$

and where $c_{bin}(k)$ is the binaural diffuse field coherence for the frequency of kth frequency index. In other words, when γ(k,n) is one, then the ambience covariance matrix $C_A$ is such that determines full coherence between the left and right ears. When γ(k,n) is zero, then $C_A$ is such that determines the coherence between left and right ears that is natural for a human listener in a diffuse field (roughly: zero at high frequencies, high at low frequencies).

Then the target covariance matrix determiner 905 may be configured to determine the direct part covariance matrix $C_D$. The amount of directional energy is rE. It is possible to use similar methods to synthesize the spread coherence parameter as in the loudspeaker reproduction, detailed below.

First the target covariance matrix determiner 905 may be configured to determine a 2×1 HRTF-vector $v_{HRTF}(k, \theta(k,n))$, where θ(k,n) is the estimated direction parameter. The target covariance matrix determiner 905 can determine a panning HRTF vector that is equivalent to reproducing sound coherently at three directions $$v_{LRC_HRTF}(k,\theta(k,n))=\frac{v_{HRTF}(k,\theta(k,n))+v_{HRTF}(k,\theta(k,n)+\theta_\Delta)+v_{HRTF}(k,\theta(k,n)-\theta_\Delta)}{\sqrt{3}},$$

where the $\theta_\Delta$ parameter defines the width of the "spread" sound energy with respect to the azimuth dimension. It could be, for example, 30 degrees.

When the spread coherence parameter ζ is less than 0.5, i.e., when the sound would be reproduced between the "direct point source" scenario and the "three-loudspeakers coherent sound" scenario the target covariance matrix determiner 905 can be configured to determine the direct part HRTF covariance matrix to be, $$C_D=rE((1-2\zeta)v_{HRTF}v_{HRTF}^H+2\zeta v_{LRC_HRTF}v_{LRC_HRTF}^H).$$

When the spread coherence parameter is between 0.5 and 1, i.e., when the sound would be reproduced between the "three-loudspeakers coherent sound" scenario and the "two spread loudspeakers coherent sound" scenario, the target covariance matrix determiner 905 can determine a spread distribution by re-utilizing the amplitude-distribution vector $v_{DISTR,3}$ (same as in the loudspeaker rendering). A combined head related transfer function (HRTF) vector can then be determined as $$v_{DISTR_HRTF}(k,\theta(k,n))=[v_{HRTF}(k,\theta,(k,n))v_{HRTF}(k,\theta(k,n)+\theta\Delta)v_{HRTF}(k,\theta(k,n)-\theta\Delta)]v_{DISTR,3}.$$

The above formula produces the weighted sum of the three HRTFs with the weights in $v_{DISTR,3}$. The direct part HRTF covariance matrix is then $$C_D=rE(v_{DISTR_HRTF}v_{DISTR_HRTF}^H).$$

Then, the target covariance matrix determiner 905 is configured to obtain the target covariance matrix $C_T=C_D+C_A$ to process the sound. As expressed above, the ambience part covariance matrix thus accounts for the ambience energy and the spatial coherence contained by the surrounding coherence parameter γ, and the direct covariance matrix accounts for the directional energy, the direction parameter, and the spread coherence parameter ζ.

The target covariance matrix determiner 905 may be configured to determine a target covariance matrix 908 for an Ambisonic output by being configured to synthesize inter-channel properties of the Ambisonic signals instead of inter-channel properties of loudspeaker surround sound. The first-order Ambisonic (FOA) output is exemplified in the following, however, it is straightforward to extend the same principles to higher-order Ambisonic output as well.

Thus the target covariance matrix determiner 905 may be configured to determine, the ambience covariance matrix $C_A$ for the Ambisonic sound. The amount of ambient or non-directional energy is (1−r)E, where E is the total energy as determined previously. The ambience part covariance matrix can be determined as $$C_A=(1-r)E\left((1-\gamma)\begin{bmatrix}1&0&0&0\\0&\frac{1}{3}&0&0\\0&0&\frac{1}{3}&0\\0&0&0&\frac{1}{3}\end{bmatrix}+\gamma\begin{bmatrix}1&0&0&0\\0&0&0&0\\0&0&0&0\\0&0&0&0\end{bmatrix}\right).$$

In other words, when γ(k,n) is one, then the ambience covariance matrix $C_A$ is such that only the $0^{th}$ order component receives a signal. The meaning of such an Ambisonic signal is reproduction of the sound spatially coherently. When γ(k,n) is zero, then $C_A$ corresponds to an Ambisonic covariance matrix in a diffuse field. The normalization of the $0^{th}$ and $1^{st}$ order elements above is according to the known SN3D normalization scheme.

Then the target covariance matrix determiner 905 may be configured to determine the direct part covariance matrix $C_D$. The amount of directional energy is rE. It is possible to use similar methods to synthesize the spread coherence parameter ζ as in the loudspeaker reproduction, detailed below.

First the target covariance matrix determiner 905 may be configured to determine a 4×1 Ambisonic panning vector $v_{Amb}(\theta(k,n))$, where θ(k,n) is the estimated direction parameter. The Ambisonic panning vector $v_{Amb}(\theta(k,n))$ contains the Ambisonic gains corresponding to direction θ(k,n). For FOA output with direction parameter at the horizontal plane (using the known ACN channel ordering scheme)

$$v_{Amb}(\theta(k,n))=\begin{bmatrix}1\\ \sin(\theta(k,n))\\ 0\\ \cos(\theta(k,n))\end{bmatrix}.$$

The target covariance matrix determiner 905 can determine a panning Ambisonic vector that is equivalent to reproducing sound coherently at three directions $$v_{LRC_Amb}(\theta(k,n))=\frac{v_{Amb}(\theta(k,n))+v_{Amb}(\theta(k,n)+\theta_\Delta)+v_{Amb}(\theta(k,n)-\theta_\Delta)}{\sqrt{3}},$$

where the $\theta_\Delta$ parameter defines the width of the "spread" sound energy with respect to the azimuth dimension. It could be, for example, 30 degrees.

When the spread coherence parameter ζ is less than 0.5, i.e., when the sound would be reproduced between the "direct point source" scenario and the "three-loudspeakers coherent sound" scenario the target covariance matrix determiner 905 can be configured to determine the direct part Ambisonic covariance matrix to be, $$C_D=rE((1-2\zeta)v_{Amb}v_{Amb}^H+2\zeta v_{LRC_Amb}v_{LRC_Amb}^H).$$

When the spread coherence parameter is between 0.5 and 1, i.e., when the sound would be reproduced between the "three-loudspeakers coherent sound" scenario and the "two spread loudspeakers coherent sound" scenario, the target covariance matrix determiner 305 can determine a spread distribution by re-utilizing the amplitude-distribution vector $v_{DISTR,3}$ (same as in the loudspeaker rendering). A combined Ambisonic panning vector can then be determined as $$v_{DISTR_Amb}(\theta(k,n))=[v_{Amb}(\theta(k,n))v_{Amb}(\theta(k,n)+\theta_\Delta)v_{Amb}(\theta(k,n)-\theta\Delta)]v_{DISTR,3}.$$

The above formula produces the weighted sum of the three Ambisonic panning vectors with the weights in $v_{DISTR,3}$. The direct part Ambisonic covariance matrix is then $$C_D=rE(v_{DISTR_Amb}v_{DISTR_Amb}^H).$$

Then, the target covariance matrix determiner 905 is configured to obtain the target covariance matrix $C_T=C_D+C_A$ to process the sound. As expressed above, the ambience part covariance matrix thus accounts for the ambience energy and the spatial coherence contained by the surrounding coherence parameter γ, and the direct covariance matrix accounts for the directional energy, the direction parameter, and the spread coherence parameter ζ.

In other words, the same general principles apply in constructing the binaural or Ambisonic or loudspeaker target covariance matrix. The main difference is to utilize HRTF data or Ambisonic panning data instead of loudspeaker amplitude panning data in the rendering of the direct part, and to utilize binaural coherence (or specific Ambisonic ambience covariance matrix handling) instead of inter-channel (zero) coherence in rendering the ambient part. It would be understood that a processor may be able to run software implementing the above and thus be able to render each of these output types.

In the above formulas the energies of the direct and ambient parts of the target covariance matrices were weighted based on a total energy estimate E from the estimated covariance matrix estimated within the covariance matrix estimator 903. Optionally, such weighting can be omitted, i.e., the direct part energy is determined as r, and the ambience part energy as (1−r). In that case, the estimated input covariance matrix is instead normalized with the total energy estimate, i.e., multiplied with 1/E. The resulting mixing matrix based on such determined target covariance matrix and normalized input covariance matrix may exactly or practically be the same than with the formulation provided previously, since the relative energies of these matrices matter, not their absolute energies.

Figure 10:
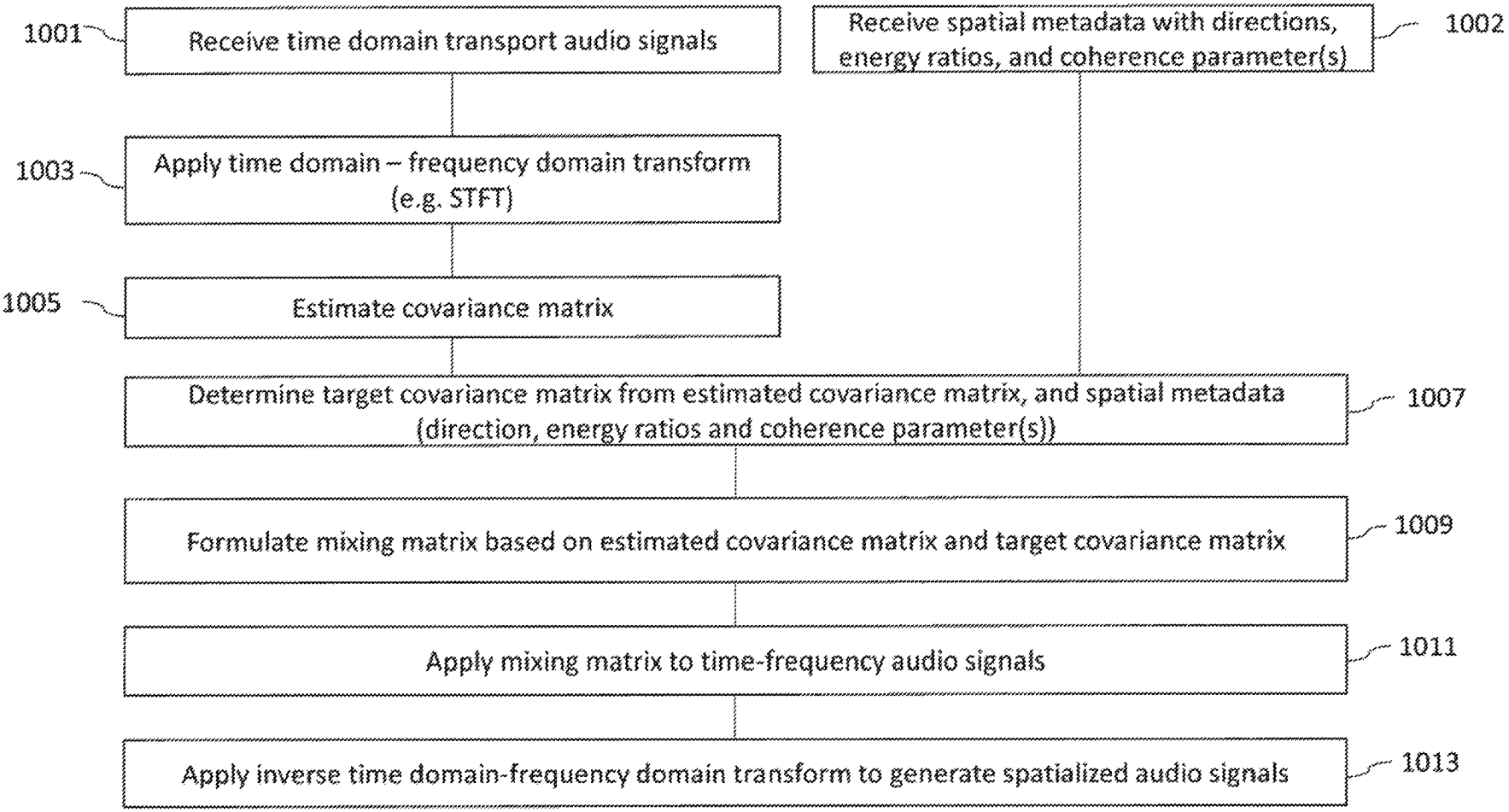
FIG. 10 shows a flow diagram of the operation of the example synthesis processor as shown in FIG. 9 according to some embodiments.

With respect to FIG. 10 an overview of the synthesis operations are shown.

The method thus may receive the time domain transport signals as shown in FIG. 10 by step 1001.

These transport signals may then be time to frequency domain transformed as shown in FIG. 10 by step 1003.

The covariance matrix may then be estimated from the input (transport) signals as shown in FIG. 10 by step 1005.

Furthermore the spatial metadata with directions, energy ratios and coherence parameters may be received as shown in FIG. 10 by step 1002.

The target covariance matrix may be determined from the estimated covariance matrix, directions, energy ratios and coherence parameter(s) as shown in FIG. 10 by step 1007.

The mixing matrix may then be determined based on estimated covariance matrix and target covariance matrix as shown in FIG. 10 by step 1009.

The mixing matrix may then be applied to the time-frequency transport signals as shown in FIG. 10 by step 1011.

The result of the application of the mixing matrix to the time-frequency transport signals may then be inverse time to frequency domain transformed to generate the spatialized audio signals as shown in FIG. 10 by step 1013.

Figure 11:
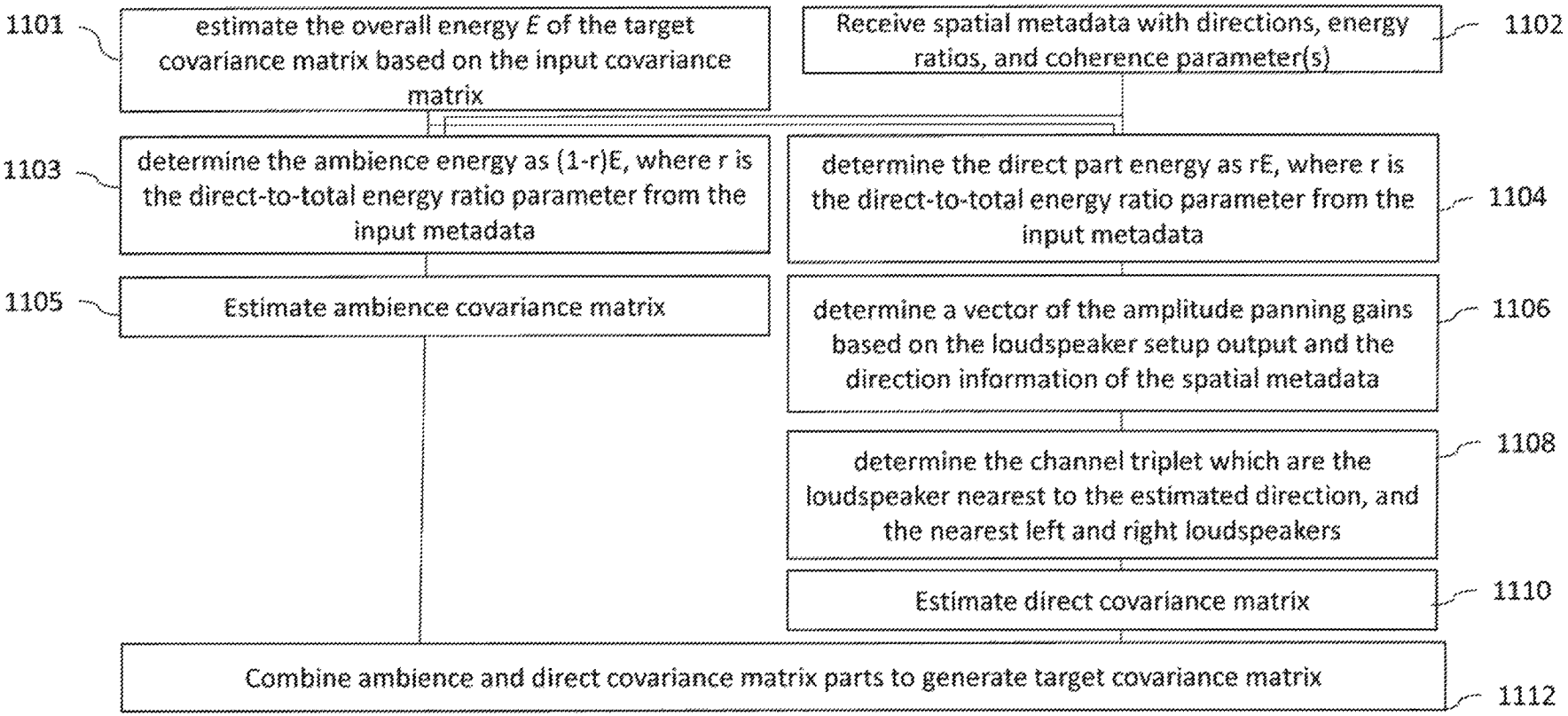
FIG. 11 shows a flow diagram of the operation of the generation of the target covariance matrix as shown in FIG. 10 according to some embodiments.

With respect to FIG. 11 an example method for generating the target covariance matrix according to some embodiments is shown.

First is to estimate the overall energy E of the target covariance matrix based on the input covariance matrix as shown in FIG. 11 by step 1101.

The method may further comprise receiving the spatial metadata with directions, energy ratios, and coherence parameter(s) as shown in FIG. 11 by step 1102.

Then the method may comprise determining the ambience energy as (1-r)E, where r is the direct-to-total energy ratio parameter from the input metadata as shown in FIG. 11 by step 1103.

Furthermore the method may comprise estimating the ambience covariance matrix as shown in FIG. 11 by step 1105.

Also the method may comprise determining the direct part energy as rE, where r is the direct-to-total energy ratio parameter from the input metadata as shown in FIG. 11 by step 1104.

The method may then comprise determining a vector of the amplitude panning gains based on the loudspeaker setup and the direction information of the spatial metadata as shown in FIG. 11 by step 1106.

Following this the method may comprise determining the channel triplet which are the loudspeaker nearest to the estimated direction, and the nearest left and right loudspeakers as shown in FIG. 11 by step 1108.

Then the method may comprise estimating the direct covariance matrix as shown in FIG. 11 by step 1110.

Finally the method may comprise combining the ambience and direct covariance matrix parts to generate target covariance matrix as shown in FIG. 11 by step 1112. The above formulation discusses the construction of the target covariance matrix.

The method may furthermore use of a prototype matrix formed according to any known manner. The prototype matrix determines a "reference signal" for the rendering with respect to which the least-squares optimized mixing matrix is formulated. In case a stereo downmix is provided as the audio signal in the codec, a prototype matrix for loudspeaker rendering can be such that determines that the signals for the left-hand side loudspeakers are optimized with respect to the provided left channel of the stereo track, and similarly for the right hand side (centre channel could be optimized with respect to the sum of the left and right audio channels). For binaural output, the prototype matrix could be such that determines that the reference signal for the left ear output signal is the left stereo channel, and similarly for the right ear. The determination of a prototype matrix is straightforward for an engineer skilled in the field having studied the prior literature. With respect to the prior literature, the novel aspect in the present formulation at the synthesis stage is the construction of the target covariance matrix utilizing also the spatial coherence metadata.

Although not repeated throughout the document, it is to be understood that spatial audio processing, both typically and in this context, takes place in frequency bands. Those bands could be for example, the frequency bins of the time-frequency transform, or frequency bands combining several bins. The combination could be such that approximates properties of human hearing, such as the Bark frequency resolution. In other words, in some cases, we could measure and process the audio in time-frequency areas combining several of the frequency bins b and/or time indices n. For simplicity, these aspects were not expressed by all of the equations above. In case many time-frequency samples are combined, typically one set of parameters such as one direction is estimated for that time-frequency area, and all time-frequency samples within that area are synthesized according to that set of parameters, such as that one direction parameter.

The usage of a frequency resolution for parameter analysis that is different than the frequency resolution of the applied filter-bank is a typical approach in the spatial audio processing systems.

Although the examples presented herein have employed microphone array audio signals as an input it is understood that in some embodiments the examples may be employed to process virtual microphone signals as an input. E.g., one can create virtual FOA signals, e.g., from multichannel loudspeaker or object signals by $$FOA_i(t) = \begin{bmatrix} w_i(t) \\ y_i(t) \\ z_i(t) \\ x_i(t) \end{bmatrix} = s_i(t) \begin{bmatrix} 1 \\ \sin(azi_i)\cos(ele_i) \\ \sin(ele_i) \\ \cos(azi_i)\cos(ele_i) \end{bmatrix}$$

The w,y,z,x signals are generated for each loudspeaker (or object) signal $s_i$ having its own azimuth and elevation direction. The output signal combining all such signals is $\Sigma_{i=1}^{NUM_CH} FOA_i(t)$.

After generating FOA signals, they can be transformed into the time-frequency domain. The directional metadata could for example be estimated with techniques such as DirAC, and the coherence metadata using the methods described herein.

The embodiments may therefore improve the perceived audio quality in three different aspects:

1) In the case of spatially separated coherent sources captured by real or virtual microphone arrays, the embodiments can detect this scenario, and reproduce the audio coherently from spatially separated loudspeakers, thus maintaining the perception similar to that of the original audio scene.

2) Determining the spatial coherence parameters from virtual microphone array input provides a straightforward way to estimate these parameters from any loudspeaker/audio object configuration through the intermediate FOA transform.

3) In the case of multiple simultaneous sources in dry acoustics, the embodiments may detect this scenario and reproduce the audio with less decorrelation, thus avoiding possible artefacts.

Figure 12:
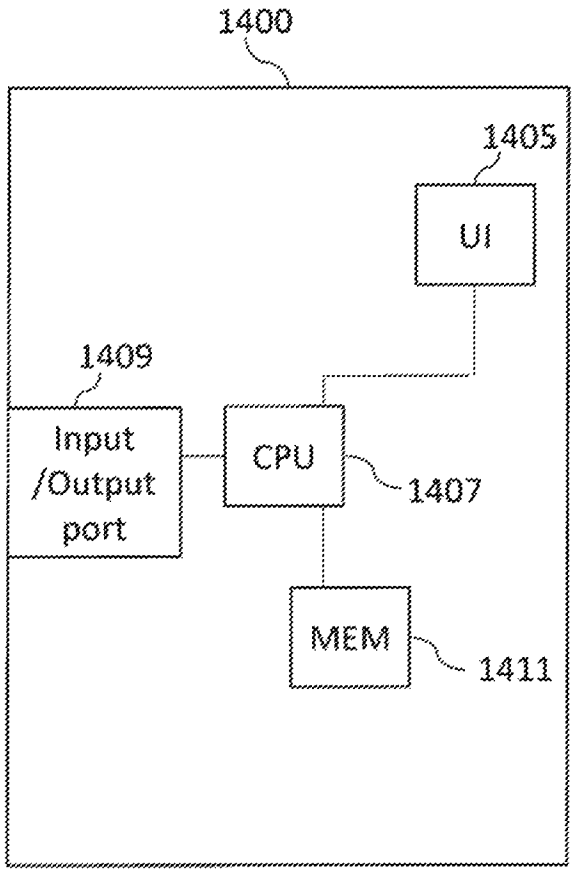
FIG. 12 shows schematically an example device suitable for implementing the apparatus shown herein.

With respect to FIG. 12 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1400 comprises at least one processor or central processing unit 1407. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400.

In some embodiments the device 1400 comprises an input/output port 1409. The input/output port 1409 in some embodiments comprises a transceiver. The transceiver in such embodiments can be coupled to the processor 1407 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1409 may be configured to receive the loudspeaker signals and in some embodiments determine the parameters as described herein by using the processor 1407 executing suitable code. Furthermore the device may generate a suitable transport signal and parameter output to be transmitted to the synthesis device.

In some embodiments the device 1400 may be employed as at least part of the synthesis device. As such the input/output port 1409 may be configured to receive the transport signals and in some embodiments the parameters determined at the capture device or processing device as described herein, and generate a suitable audio signal format output by using the processor 1407 executing suitable code. The input/output port 1409 may be coupled to any suitable audio output for example to a multichannel speaker system and/or headphones or similar.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, $C_D$.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one non-transitory memory including a computer program code, the at least one memory and the computer program code configured to, with the at least one processor, cause the apparatus at least to:

determine, for two or more microphone audio signals, a plurality of spatial audio parameters for providing spatial audio reproduction, wherein the plurality of spatial audio parameters are associated with respective frequency bands of at least two frequency bands of the two or more microphone audio signals;

determine at least one coherence parameter associated with a sound field based on the two or more microphone audio signals, such that another sound field is configured to be reproduced based on the plurality of spatial audio parameters and the at least one coherence parameter; and output the at least one coherence parameter and the plurality of spatial audio parameters.

2. The apparatus as claimed in claim 1, wherein the at least one coherence parameter comprises at least one of:

at least one spread coherence parameter based on a determination of coherence within the sound field, the at least one spread coherence parameter being associated with a coherence of a directional part of the sound field; or at least one surrounding coherence parameter based on the determination of the coherence within the sound field, the at least one surrounding coherence parameter being associated with a coherence of a non-directional part of the sound field.

3. The apparatus as claimed in claim 1, wherein the plurality of spatial audio parameters comprises at least one of:

a direction parameter;

an energy ratio parameter;

a direct-to-total energy parameter;

a directional stability parameter; or an energy parameter.

4. The apparatus as claimed in claim 1, further caused to determine an associated audio signal based on the two or more microphone audio signals, wherein the sound field is reproduced based on the plurality of spatial audio parameters, the at least one coherence parameter and the associated audio signal.

5. The apparatus as claimed in claim 1, wherein the apparatus is caused to determine the at least one coherence parameter based on a determination of coherence within the sound field, being further caused to:

determine zeroth and first order spherical harmonics based on the two or more microphone audio signals;

generate at least one general coherence parameter based on the zeroth and first order spherical harmonics; and generate the at least one coherence parameter based on the at least one general coherence parameter.

6. The apparatus as claimed in claim 1, wherein the apparatus is further caused to determine zeroth and first order spherical harmonics based on the two or more microphone audio signals, and is further caused to one of:

determine time domain zeroth and first order spherical harmonics based on the two or more microphone audio signals and convert the time domain zeroth and first order spherical harmonics to time-frequency domain zeroth and first order spherical harmonics; or convert the two or more microphone audio signals into respective two or more time-frequency domain microphone audio signals and generate the time-frequency domain zeroth and first order spherical harmonics based on the two or more time-frequency domain microphone audio signals.

7. The apparatus as claimed in claim 5, wherein when the at least one coherence parameter is generated, the apparatus is further caused to generate:

at least one spread coherence parameter based on the at least one general coherence parameter and an energy ratio configured to define a relationship between a direct part and an ambient part of the sound field; and at least one surrounding coherence parameter based on the at least one general coherence parameter and the energy ratio configured to define the relationship between the direct part and the ambient part of the sound field.

8. The apparatus as claimed in claim 1, wherein when the at least one coherence parameter is determined, the apparatus is caused to:

convert the two or more microphone audio signals into respective two or more time-frequency domain microphone audio signals;

determine at least one estimate of non-reverberant sound based on the two or more time-frequency domain microphone audio signals; and determine at least one surrounding coherence parameter based on the at least one estimate of non-reverberant sound and an energy ratio configured to define a relationship between a direct part and an ambient part of the sound field.

9. The apparatus as claimed in claim 8, wherein the apparatus is further caused to:

select one of:

the at least one surrounding coherence parameter based on the at least one estimate of non-reverberant sound and the energy ratio; or at least one surrounding coherence parameter based on at least one general coherence parameter, based on which surrounding coherence parameter is largest.

10. The apparatus as claimed in claim 1, wherein the apparatus is further caused to determine the at least one coherence parameter for the respective frequency bands of the at least two frequency bands.

11. An apparatus comprising at least one processor and at least one non-transitory memory including a computer program code, the at least one memory and the computer program code configured to, with the at least one processor, cause the apparatus at least to:

receive at least one audio signal, the at least one audio signal based on two or more microphone audio signals;

receive at least one coherence parameter, associated with a sound field based on the two or more microphone audio signals;

receive a plurality of spatial audio parameters for providing spatial audio reproduction, wherein the plurality of spatial audio parameters are associated with respective frequency bands of at least two frequency bands of the two or more microphone audio signals; and reproduce another sound field based on the at least one audio signal, the plurality of spatial audio parameters and the at least one coherence parameter.

12. The apparatus as claimed in claim 11, wherein the at least one coherence parameter comprises at least one of:

at least one spread coherence parameter for the at least two frequency bands, the at least one spread coherence parameter being associated with a coherence of a directional part of the sound field; or at least one surrounding coherence parameter, the at least one surrounding coherence parameter being associated with a coherence of a non-directional part of the sound field.

13. The apparatus as claimed in claim 12, wherein the plurality of spatial audio parameters comprises at least one of:

a direction parameter;

an energy ratio parameter;

a direct-to-total energy parameter;

a directional stability parameter; or an energy parameter, and where the apparatus is further caused to:

determine a target covariance matrix from the at plurality of spatial audio parameters, the at least one coherence parameter and an estimated energy of the at least one audio signal;

generate a mixing matrix based on the target covariance matrix and the estimated energy of the at least one audio signal; and apply the mixing matrix to the at least one audio signal to generate at least two output spatial audio signals for reproducing the another sound field.

14. The apparatus as claimed in claim 13, wherein the apparatus is further caused to:

determine a total energy parameter based on the estimated energy of the at least one audio signal;

determine a direct energy and an ambience energy based on at least one of:

the energy ratio parameter;

the direct-to-total energy parameter;

the directional stability parameter; or the energy parameter;

estimate an ambience covariance matrix based on the determined ambience energy and one of the at least one coherence parameter;

estimate at least one of:

a vector of amplitude panning gains, an Ambisonic panning vector, or at least one head related transfer function, based on an output channel configuration and/or the direction parameter;

estimate a direct covariance matrix based on the vector of amplitude panning gains, the Ambisonic panning vector or the at least one head related transfer function, the determined direct energy and a further one of the at least one coherence parameter; and generate the target covariance matrix, comprising combining the ambience covariance matrix and the direct covariance matrix.

15. A method comprising:

determining, for two or more microphone audio signals, a plurality of spatial audio parameters for providing spatial audio reproduction, wherein the plurality of spatial audio parameters are associated with respective frequency bands of at least two frequency bands of the two or more microphone audio signals;

determining at least one coherence parameter associated with a sound field based on the two or more microphone audio signals, such that another sound field is configured to be reproduced based on the plurality of spatial audio parameters and the at least one coherence parameter; and outputting the at least one coherence parameter and the plurality of spatial audio parameters.

16. The method as claimed in claim 15, wherein determining the plurality of spatial audio parameters further comprises determining, for the two or more microphone audio signals, at least one of:

a direction parameter;

an energy ratio parameter;

a direct-to-total energy parameter;

a directional stability parameter; or an energy parameter.

17. The method as claimed in claim 15, wherein determining the at least one coherence parameter comprises at least one of:

converting the two or more microphone audio signals into respective two or more time-frequency domain microphone audio signals;

determining at least one estimate of non-reverberant sound based on the two or more time-frequency domain microphone audio signals;

determining at least one surrounding coherence parameter based on the at least one estimate of non-reverberant sound and an energy ratio configured to define a relationship between a direct part and an ambient part of the sound field; or selecting one of:

the at least one surrounding coherence parameter based on the at least one estimate of non-reverberant sound and the energy ratio; or the at least one surrounding coherence parameter based on at least one general coherence parameter, based on which surrounding coherence parameter is largest.

18. A method comprising:

receiving at least one audio signal, the at least one audio signal based on two or more microphone audio signals;

receiving at least one coherence parameter, associated with a sound field based on the two or more microphone audio signals;

receive a plurality of spatial audio parameters for providing spatial audio reproduction, wherein the plurality of spatial audio parameters are associated with respective frequency bands of at least two frequency bands of the two or more microphone audio signals; and reproducing another sound field based on the at least one audio signal, the plurality of spatial audio parameters and the at least one coherence parameter.

19. The method as claimed in claim 18, wherein the plurality of spatial audio parameters comprises at least one of:

a direction parameter;

an energy ratio parameter;

a direct-to-total energy parameter;

a directional stability parameter; or an energy parameter, and where the method further comprises reproducing the another sound field, the plurality of spatial audio parameters and the at least one coherence parameter for at least one of:

determining a target covariance matrix from the plurality of spatial audio parameters, the at least one coherence parameter and an estimated energy of the at least one audio signal;

generating a mixing matrix based on the target covariance matrix and the estimated energy of the at least one audio signal; or applying the mixing matrix to the at least one audio signal for generating at least two output spatial audio signals for reproducing the another sound field.

20. The method as claimed in claim 18, wherein receiving the at least one coherence parameter further comprises receiving at least one of:

at least one spread coherence parameter for the at least two frequency bands, the at least one spread coherence parameter being associated with a coherence of a directional part of the sound field; or at least one surrounding coherence parameter, the at least one surrounding coherence parameter being associated with a coherence of a non-directional part of the sound field.

* * * * *